US010804625B2

(12) United States Patent
Kutsuna et al.

(10) Patent No.: US 10,804,625 B2
(45) Date of Patent: Oct. 13, 2020

(54) TERMINAL, METHOD OF CONNECTING ELECTRIC WIRE TO TERMINAL, AND JIG

(71) Applicant: Yazaki Corporation, Tokyo (JP)

(72) Inventors: Youji Kutsuna, Makinohara (JP); Keiichiro Kurashige, Makinohara (JP); Kazuhiko Takada, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/667,167

(22) Filed: Oct. 29, 2019

(65) Prior Publication Data

US 2020/0144740 A1 May 7, 2020

(30) Foreign Application Priority Data

Nov. 5, 2018 (JP) ..... 2018-208297

(51) Int. Cl.
*H01R 9/11* (2006.01)
*H01R 13/52* (2006.01)
*H01R 43/048* (2006.01)

(52) U.S. Cl.
CPC ..... *H01R 9/11* (2013.01); *H01R 13/5213* (2013.01); *H01R 43/048* (2013.01)

(58) Field of Classification Search
CPC .... H01R 9/11; H01R 13/5213; H01R 43/048; H01R 4/18
See application file for complete search history.

(56) References Cited

U.S. PATENT DOCUMENTS

| | | | | |
|---|---|---|---|---|
| 9,136,628 | B2 * | 9/2015 | Aizawa | H01R 4/185 |
| 9,853,368 | B2 * | 12/2017 | Myer | H01R 4/185 |
| 2013/0095708 | A1 * | 4/2013 | Mitose | H01R 43/005 439/878 |
| 2017/0179614 | A1 * | 6/2017 | Kitagawa | H01R 4/188 |
| 2018/0109088 | A1 * | 4/2018 | Takayanagi | H01R 43/052 |
| 2020/0127390 | A1 * | 4/2020 | Matsunaga | H01R 13/4361 |
| 2020/0169022 | A1 * | 5/2020 | Kawashima | H01R 13/639 |

FOREIGN PATENT DOCUMENTS

JP 2003-203743 A 7/2003

* cited by examiner

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A terminal includes a connecting portion, a cover fixing portion configured to fix a cover of an electric wire, and a conductor fixing portion configured to fix a conductor core wire exposed from the cover of the electric wire. The conductor fixing portion has a holding portion which has an insertion portion and is configured to hold at least one side of the conductor core wire inserted into the insertion portion, and an elastic deformation portion which does not allow the conductor core wire to be inserted through the insertion portion by interference between the elastic deformation portion and the conductor core wire when the elastic deformation portion is at an initial position and which allows the conductor core wire to be inserted through the insertion portion when the elastic deformation portion is at a deformed position.

5 Claims, 25 Drawing Sheets

TERMINAL, METHOD OF CONNECTING ELECTRIC WIRE TO TERMINAL, AND JIG

CROSS REFERENCE TO RELATED APPLICATIONS

This application is based on Japanese Patent Application (No. 2018-208297) filed on Nov. 5, 2018, the contents of which are incorporated herein by reference.

BACKGROUND OF THE INVENTION

1. Field of the Invention

The present invention relates to a terminal, a method of connecting an electric wire to a terminal, and a jig.

2. Description of the Related Art

In the related art, a connector, which includes a housing including a terminal housing portion that houses a terminal connected to an electric wire, is widely known (see, for example, JP-A-2003-203743). In this type of connector, usually, the terminal connected to the electric wire is housed in a normal insertion position of the terminal housing portion by inserting the terminal into the terminal housing portion from the rear end of the housing while crimping and fixing the terminal to the electric wire and holding the electric wire to which the terminal is fixed.

In recent years, with a demand for miniaturization of the connector, the terminal has been reduced in size, and the electric wire has also been reduced in diameter. When the electric wire to which the terminal is fixed is held and the terminal is inserted from the rear end of the housing when the electric wire is thin, the electric wire is likely to be bent due to the mass of the terminal acting on the electric wire and the long distance from the holding position of the electric wire to the front end of the terminal. When the electric wire is bent, it is difficult to aim at the opening of the terminal housing portion at the rear end of the housing and insert the terminal into the opening.

On the other hand, this problem can be easily solved by using the assembly procedure of connecting the electric wire to the terminal after housing only the terminal in the terminal housing portion of the housing. From the above, it is desirable to develop a terminal that can be easily connected to an electric wire after only the terminal is housed in the terminal housing portion of the housing.

SUMMARY OF THE INVENTION

The present invention has been made in view of the above circumstances, and an aspect of the present invention is to provide a terminal that can be easily connected to an electric wire after only the terminal is housed in a terminal housing portion of a housing, a method of connecting the electric wire to the terminal, and a jig.

In order to achieve the above-described aspect, a terminal, a method of connecting an electric wire to the terminal, and a jig according to the present invention are characterized by the following (1) to (5).

(1) A terminal configured to be connected to a front end of an electric wire having a conductor core wire and a cover covering the conductor core wire, and which extends in a front-rear direction, the terminal including:

a connecting portion configured to be connected to a mating terminal;

a cover fixing portion which is located rearward of the connecting portion and is configured to fix the cover of the electric wire; and a conductor fixing portion which is located between the connecting portion and the cover fixing portion and is configured to fix the conductor core wire exposed from the cover of the electric wire, in which the connecting portion, the cover fixing portion and the conductor fixing portion are integrally formed of a single material which is a plate-shaped member;

in which the conductor fixing portion comprises:

a holding portion which has an insertion portion through which the conductor core wire is inserted and is configured to hold at least one side of the conductor core wire inserted into the insertion portion in a width direction of the conductor core wire; and an elastic deformation portion which does not allow the conductor core wire to be inserted through the insertion portion by interference between the elastic deformation portion and the conductor core wire when the elastic deformation portion is at an initial position and which allows the conductor core wire to be inserted through the insertion portion when the elastic deformation portion is at a deformed position where the elastic defoiination portion is elastically deformed from the initial position to the other side opposite to the one side in the width direction, the elastic deformation portion being disposed at a position different from the holding portion in the front-rear direction and being elastically deformable in the width direction;

in which the holding portion and the elastic deformation portion are integrally formed of a single material; and in which the elastic deformation portion is at the deformed position by application of an external force and then the application of the external force is released in a state that the conductor core wire is inserted through the insertion portion, so that the conductor core wire is fixed by the conductor fixing portion by being sandwiched between the holding portion and the elastic deformation portion in the width direction by an elastic restoring force of the elastic deformation portion.

(2) The terminal according to the item (1), in which the elastic deformation portion comprises:

a pair of elastic pieces which do not allow the conductor core wire to be inserted through the insertion portion by interference between the pair of elastic pieces and the conductor core wire when the pair of elastic pieces is at the initial position and which allow the conductor core wire to be inserted through the insertion portion when the pair of elastic pieces is at the deformed position, the pair of elastic pieces being disposed forward and rearward from the holding portion in the front-rear direction and being elastically deformable in the width direction; and a connecting portion which connects extended end parts of the pair of elastic pieces to each other and extends in the front-rear direction; and in which the pair of elastic pieces are at the deformed position by application of an external force to the connecting portion and then the application of the external force is released in a state that the conductor core wire is inserted through the insertion portion, so that the conductor core wire is fixed by the conductor fixing portion by being sandwiched between the holding portion and the pair of elastic pieces in the width direction by an elastic restoring force of the pair of elastic pieces.

(3) A method of connecting the electric wire to the terminal according to the item 1 or 2, the method including:

housing the terminal in a terminal housing portion of a housing;

applying an external force to the elastic deformation portion of the terminal housed in the terminal housing portion to maintain the elastic deformation portion at the deformed position;

inserting the conductor core wire through the insertion portion in a state that the elastic deformation portion is kept at the deformed position by applying the external force; and fixing the conductor core wire to the conductor fixing portion by releasing the application of the external force in a state that the conductor core wire is inserted through the insertion portion and sandwiching the conductor core wire between the holding portion and the elastic deformation portion in the width direction by an elastic restoring force of the elastic deformation portion.

(4) A jig used in the method according to the item (3), the jig including:

a pressing portion configured to press the elastic deformation portion of the terminal housed in the terminal housing portion downward from an upper side, in which, when the pressing portion is pressed downward with respect to the elastic deformation portion, a pressing surface of the pressing portion, which is located at a bottom part of the pressing portion and is configured to press the elastic deformation portion, is inclined to the other side in the width direction with respect to a horizontal surface such that the elastic deformation portion is deformed to the other side.

(5) The jig according to the item (4), further including:

a guide portion which is located side by side with the pressing portion and is configured to guide the conductor core wire toward the insertion portion, in which the guide portion and the pressing portion are integrally formed of a single material; and in which a protruding portion, which is configured to guide the conductor core wire toward a center of the insertion portion, is provided on a guide surface which is located at a bottom part of the guide portion and is configured to guide the conductor core wire toward the insertion portion.

According to the terminal having the configuration (1), when the electric wires are connected to the terminals after the terminals are housed in the terminal housing portions of the housing, the elastic deformation portion is at the deformed position by the application of an external force and the conductor core wire is inserted through the insertion portion. In this state, the conductor core wire of the electric wire can be fixed to the terminal only by releasing the application of the external force. Therefore, even after the terminals are housed in the terminal housing portions of the housing, the electric wires can be extremely easily connected to the terminals.

According to the terminal having the configuration (2), the conductor core wire is sandwiched at two different places in the extending direction by the holding portion and the pair of elastic pieces. Therefore, the conductor core wire of the electric wire can be more firmly fixed to the terminal as compared with an aspect in which the conductor core wire is sandwiched only at one place in the extending direction.

According to the method of connecting the electric wire to the terminal having the configuration (3), when the electric wires are connected to the terminals after the terminals are housed in the terminal housing portions of the housing, the elastic deformation portion is at the deformed position by the application of an external force and the conductor core wire is inserted through the insertion portion. In this state, the conductor core wire of the electric wire can be fixed to the terminal only by releasing the application of the external force. Therefore, even after the terminals are housed in the terminal housing portions of the housing, the electric wires can be extremely easily connected to the terminals.

According to the jig having the configuration (4), the pressing surface of the pressing portion is inclined to the other side with respect to the horizontal plane. Therefore, the elastic deformation portion can be reliably elastically deformed to the other side only by moving the pressing portion downward from the upper side.

According to the jig having the configuration (5), the projection portion is provided on the guide surface of the guide portion, so that the front end of the conductor core wire can be reliably guided into the insertion portion by inserting the conductor core wire into the insertion portion while sliding the front end of the conductor core wire on the guide surface of the guide portion.

According to the present invention, it is possible to provide a terminal that can be easily connected to an electric wire after only the terminal is housed in a terminal housing portion of a housing, a method of connecting the electric wire to the terminal, and a jig.

The present invention has been briefly described as above. Details of the present invention will be further clarified by reading a mode (hereinafter, referred to as "embodiment") for carrying out the present invention described below with reference to the accompanying drawings.

DETAILED DESCRIPTION OF THE EXEMPLARY EMBODIMENTS

Embodiment

Figure 1:
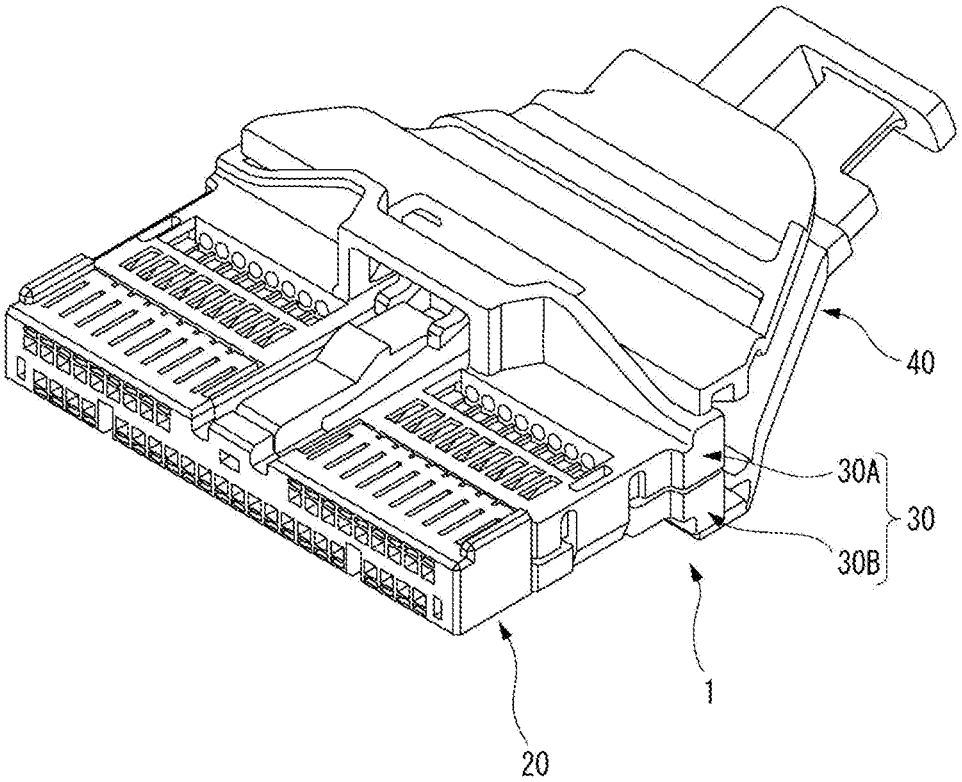
FIG. 1 is a perspective view of a connector including a terminal according to the present embodiment.

Hereinafter, a connector 1 including terminals 10 according to an embodiment of the present invention will be described with reference to the drawings. Hereinafter, for convenience of description, in the axial direction (the fitting direction) of the connector 1, a side (a left side in FIG. 1) on which a mating terminal (not illustrated) is fitted is referred to as a front side, and an opposite side (a right side in FIG. 1) of the front side is referred to as a rear side. An upper side and a lower side in FIG. 1 are referred to as an upper side and a lower side, respectively.

Figure 2:
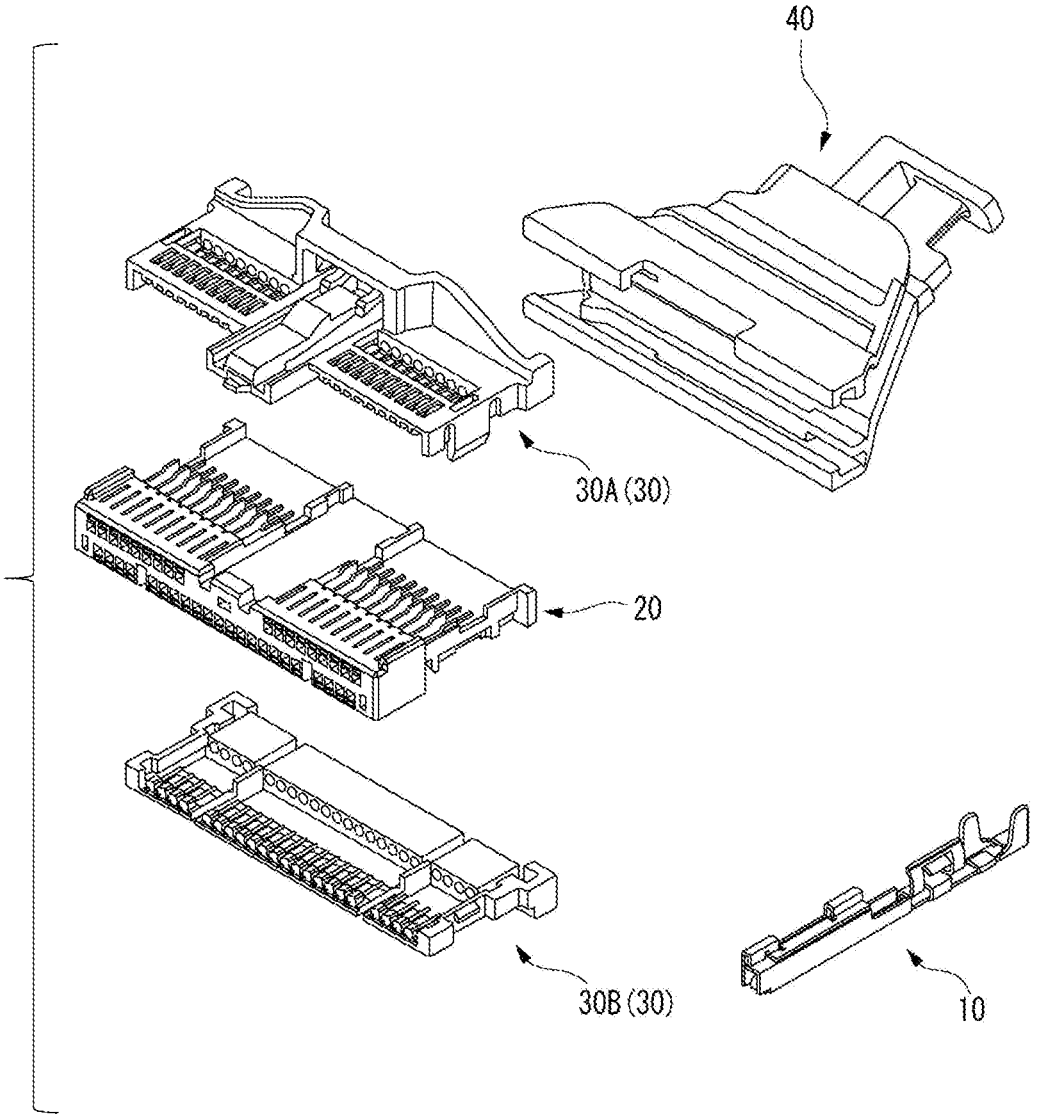
FIG. 2 is an exploded perspective view of the connector illustrated in FIG. 1.

As illustrated in FIG. 2, the connector 1 includes the terminals 10, a housing 20, a cover 30, and a connector cover 40. Hereinafter, each component forming the connector 1 will be described in order.

Figure 3:
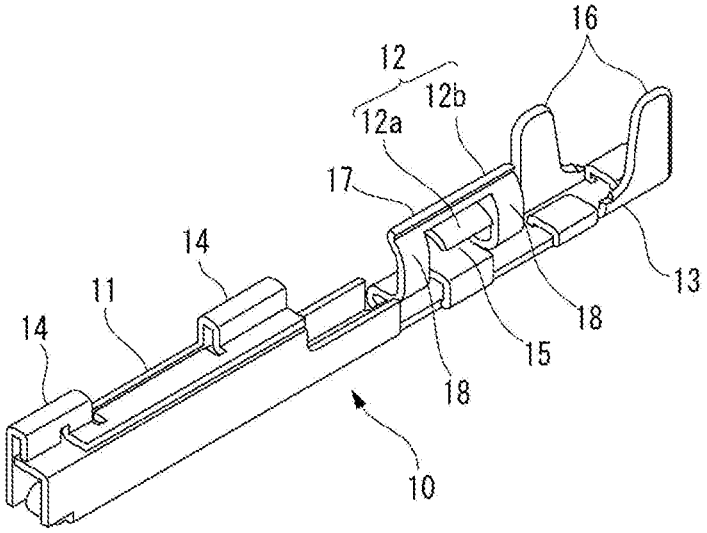
FIG. 3 is a perspective view of the terminal illustrated in FIG. 2.
Figure 4:
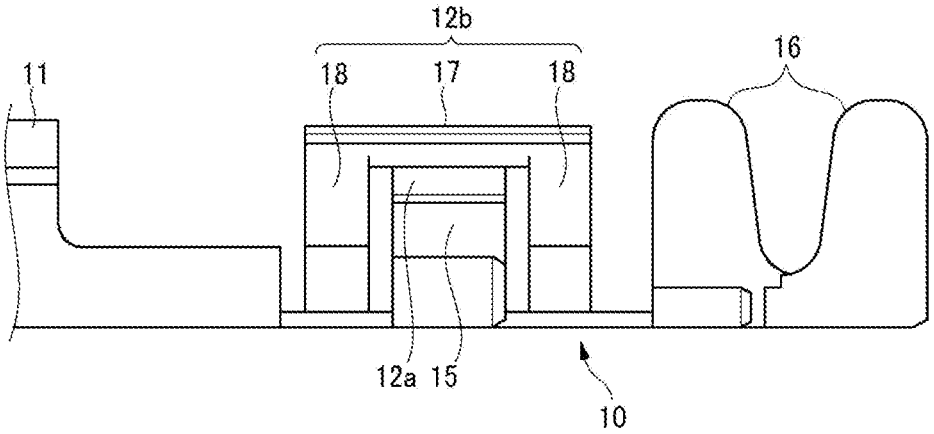
FIG. 4 is a side view of a conductor fixing portion of the terminal.

First, the terminals 10 will be described with reference to FIGS. 3 to 5. The terminals 10 are female terminals formed by pressing, bending, or the like on a plate-shaped metal member, and include a connecting portion 11 to which a mating terminal (a male terminal, not illustrated) is fitted, a conductor fixing portion 12 which is configured to fix a conductor core wire of an electric wire (not illustrated) to the rear side of the connecting portion 11, and a coating fixing portion 13 which is continuous with the rear side of the conductor fixing portion 12 and is configured to fix a covering of the electric wire.

The connecting portion 11 has a rectangular tubular shape, and a pair of protruding portions 14 protruding upward are formed on both end portions in the front-rear direction on one side of the upper surface of the connecting portion 11 in the width direction. In particular, the protruding portion 14 on the front side of the pair of protruding portions 14 is engaged with a lance 26 (see FIG. 8) of the housing 20, and performs a function of preventing the terminals 10 from coming off, as will be described later.

Figure 30:
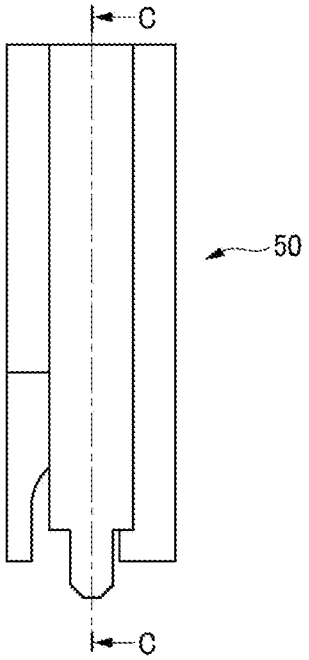
FIG. 30 is a front view of the jig.
Figure 31:
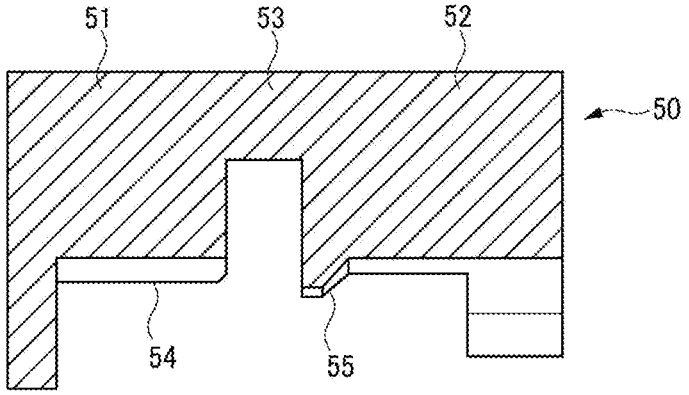
FIG. 31 is a cross-sectional view taken along a line C-C in FIG. 30.

The conductor fixing portion 12 includes a holding portion 12*a* and an elastic deformation portion 12*b*. The holding portion 12*a* is a plate-shaped portion bent in a cylindrical shape whose front end part extends in the front-rear direction and whose cylindrical part functions as an insertion portion 15 through which a conductor core wire W1 (see FIG. 30) of an electric wire W is inserted. In the present embodiment, the insertion portion 15 is not a cylindrical shape completely closed in the circumferential direction, and a part on the right side as viewed from the front (the front side) is opened (in particular, see FIG. 5).

The elastic deformation portion 12*b* includes a pair of elastic pieces 18 extending upward from a vicinity of the front side and a vicinity of the rear side with respect to the holding portion 12*a* (the insertion portion 15), and a connecting portion 17 which connects extended end parts of the pair of elastic pieces 18 to each other and extends in the front-rear direction.

Figure 5:
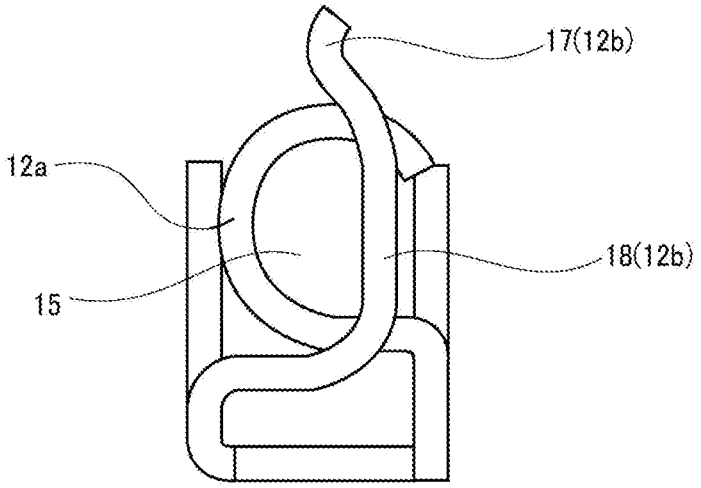
FIG. 5 is a front view of the conductor fixing portion of the terminal.

The pair of elastic pieces 18 are elastically deformable in the width direction and cross the inside area of the insertion portion 15 in the substantially upper-lower direction as viewed from the front-rear direction at an "initial position" illustrated in FIG. 5. Therefore, even if the conductor core wire W1 is to be inserted through the insertion portion 15, the conductor core wire W1 cannot be inserted through the insertion portion 15 due to interference between the conductor core wire W1 and the elastic pieces 18. On the other hand, when the pair of elastic pieces 18 are at a "deformed position" which is elastically deformed from the "initial position" to the right side as viewed from the front (the front side) (see FIG. 34), the pair of elastic pieces 18 move out of the inside area of the insertion portion 15 as viewed from the front-rear direction. Therefore, the conductor core wire W1 can be inserted through the insertion portion 15. A method of fixing the conductor core wire W1 of the electric wire W by the conductor fixing portion 12 will be described in detail below.

A pair of crimping pieces 16 are formed on the cover fixing portion 13. The electric wire W is fixed to the cover fixing portion 13 by crimping a cover W2 of the electric wire W with the crimping pieces 16.

Figure 6:
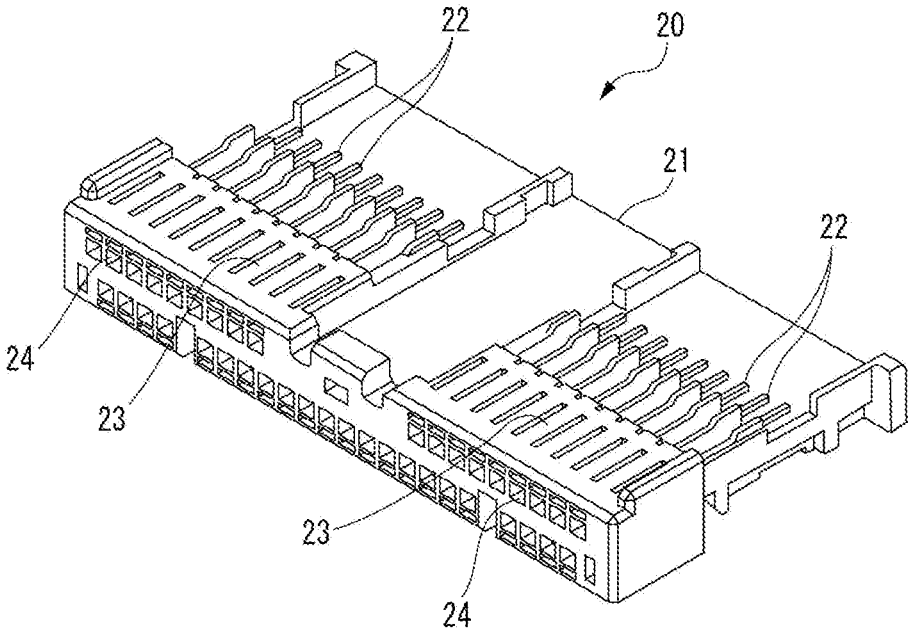
FIG. 6 is a perspective view of a housing illustrated in FIG. 2.
Figure 7:
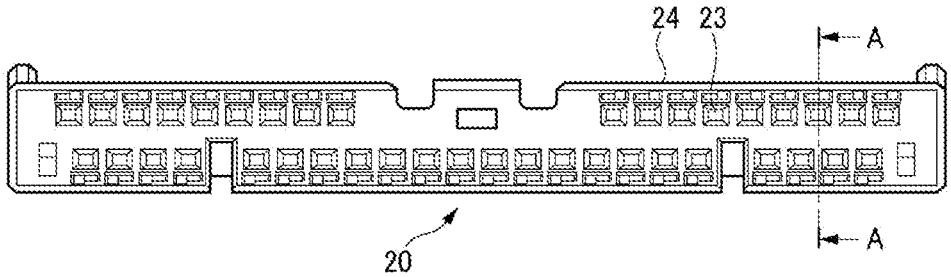
FIG. 7 is a front view of the housing.

Next, the housing 20 will be described with reference to FIGS. 6 to 12. In particular, as illustrated in FIGS. 6 and 9, the housing 20 includes a housing main body 21 having a rectangular flat plate shape. A plurality of terminal housing portions, which are configured to house a plurality of the terminals 10, are formed on each of upper and lower surfaces of the housing main body 21. The configurations of the upper surface side and the lower surface side of the housing main body 21 are slightly different from each other, but are substantially the same. Therefore, only the configuration of the upper surface side of the housing main body 21 will be described below.

A plurality of standing walls 22 extending in the front-rear direction at intervals in the width direction are integrally formed on the upper surface of the housing main body 21. Each standing wall 22 performs a function of partitioning two terminal housing portions adjacent in the width direction. That is, a plurality of the terminal housing portions partitioned by a plurality of the standing walls 22 are formed on the upper surface of the housing main body 21 so as to be aligned in the width direction.

Top wall portions 23 are formed integrally on the front side part of the housing main body 21 so as to close the upper side of each of the terminal housing portions. That is, the front side part of each of the terminal housing portions has a cylindrical shape whose upper side is closed by one of the top wall portions 23, and the upper side of the rear side part of each of the terminal housing portions is opened. An opening 24 is formed at the front side end of each of the terminal housing portions (see FIGS. 6 to 8). The mating terminal (the male terminal) is inserted into each of the terminal housing portions of the housing main body 21 through the opening 24.

Figure 8:
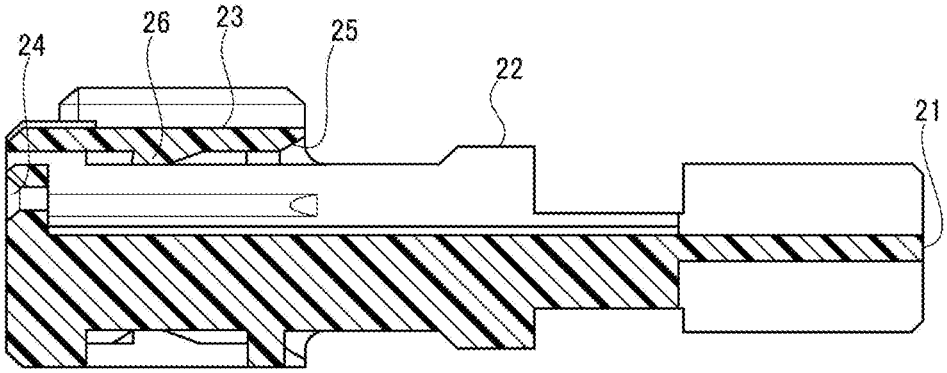
FIG. 8 is a cross-sectional view taken along a line A-A in FIG. 7.
Figure 9:
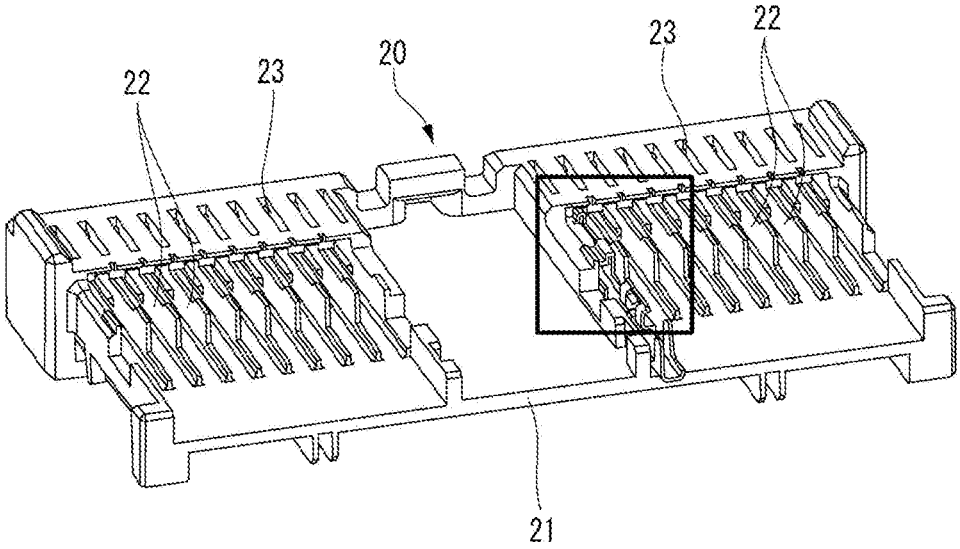
FIG. 9 is a perspective view of the housing as viewed from the rear side.

As illustrated in FIG. 8, a tapered surface 25 inclined rearward and downward is formed at the rear end edge of each of the top wall portions 23. As will be described later, the tapered surface 25 is used when an upper cover 30A is assembled to the housing 20 (see FIG. 21). A lance 26 protruding downward into each of the terminal housing portions is integrally formed on the lower surface of the central part of the top wall portion 23 in the front-rear direction.

Figure 10:
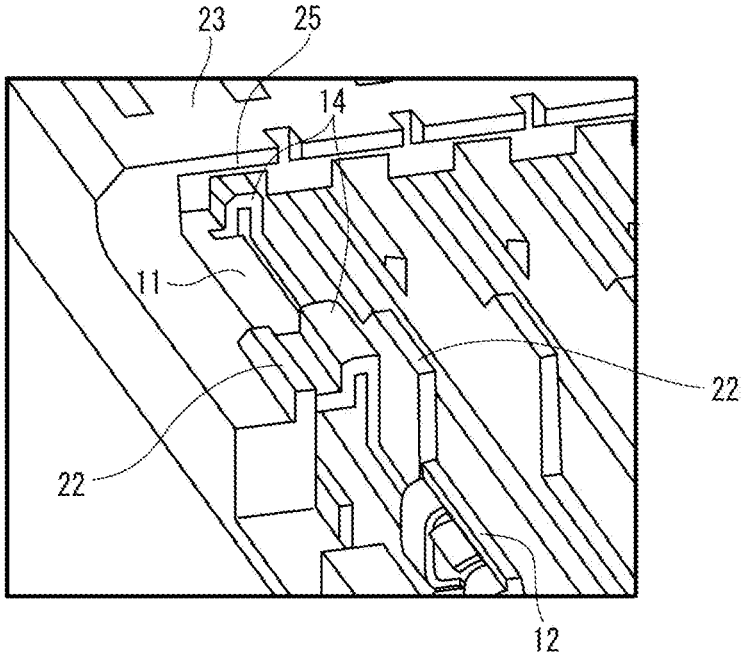
FIG. 10 is an enlarged view of the inside of the frame in FIG. 9.

As described above, in the housing main body 21, the upper side of the rear side part of each of the terminal housing portions is opened. Therefore, the terminal 10 is placed on the rear side part of the terminal housing portion and the front side is pushed as illustrated in FIGS. 9 and 10 while the terminal 10 is held, so that the terminal 10 can be easily inserted into a primary locking position (an intermediate insertion position) in a vicinity of the normal insertion position on the front side part (the cylindrical part) of the terminal housing portion (see FIGS. 11 and 12).

Figure 11:
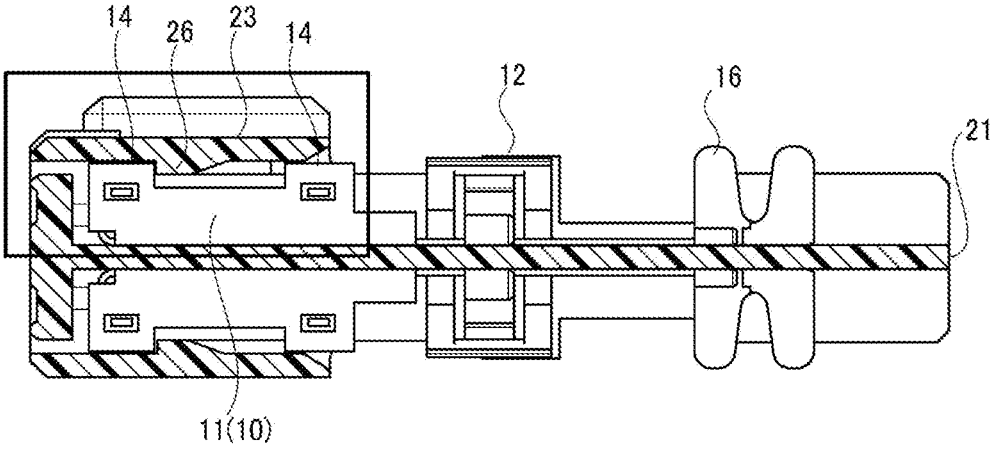
FIG. 11 is a cross-sectional view corresponding to FIG. 8 in the housing in which the terminal is in a primary locking position.
Figure 12:
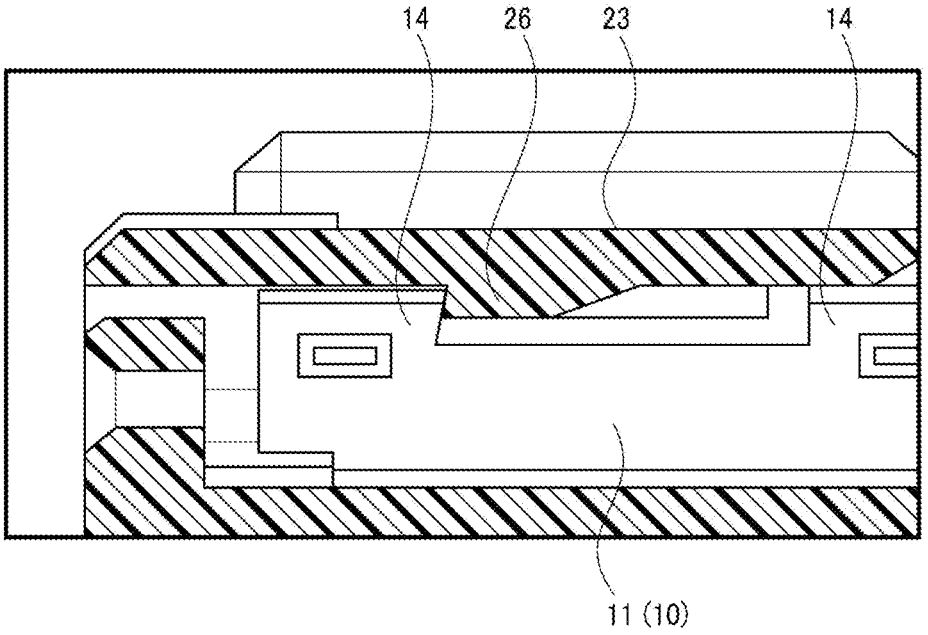
FIG. 12 is an enlarged view of the inside of the frame in FIG. 11.

In the process in which the terminal 10 is inserted into the primary locking position illustrated in FIGS. 11 and 12, the lance 26 abuts against the protruding portion 14 on the front side of the terminal 10 to ride on the protruding portion 14 while elastically deforming, and then elastically returns to the initial position when the protruding portion 14 passes by. As a result, as illustrated in FIG. 12, the protruding portion 14 is engaged with the lance 26 so as to performs a function of preventing terminals 10 from coming off from the housing 20.

Next, the cover 30 will be described with reference to FIGS. 13 to 22. In the present embodiment, an upper cover 30A and a lower cover 30B are used as the cover 30 (see FIG. 2). The upper cover 30A is assembled to the upper surface side of the housing main body 21 to close the upper side of the rear side part of each of the terminal housing portions on the upper surface side, and the lower cover 30B is assembled to the lower surface side of the housing main body 21 to close the lower side of the rear side part of each of the terminal housing portions on the lower surface side.

Figure 13:
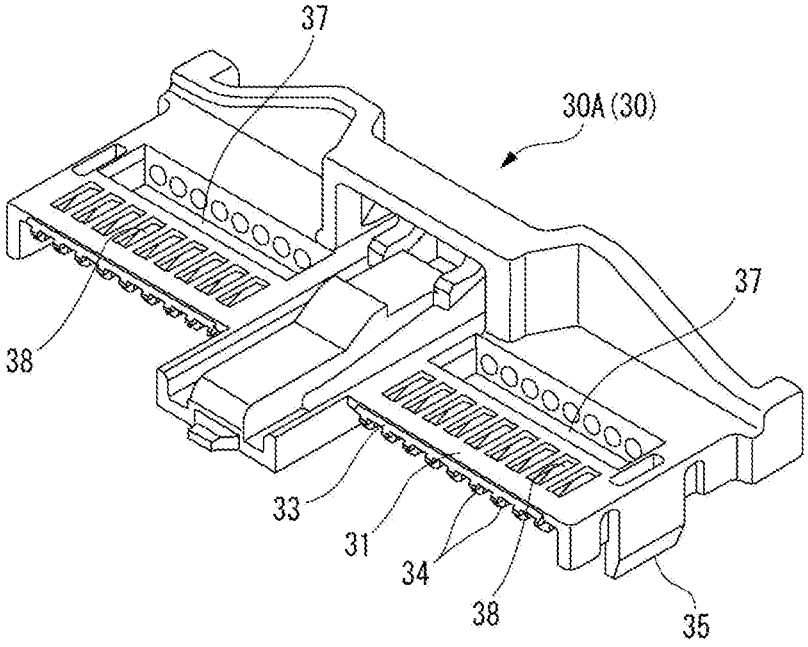
FIG. 13 is a perspective view of an upper cover illustrated in FIG. 2.
Figure 14:
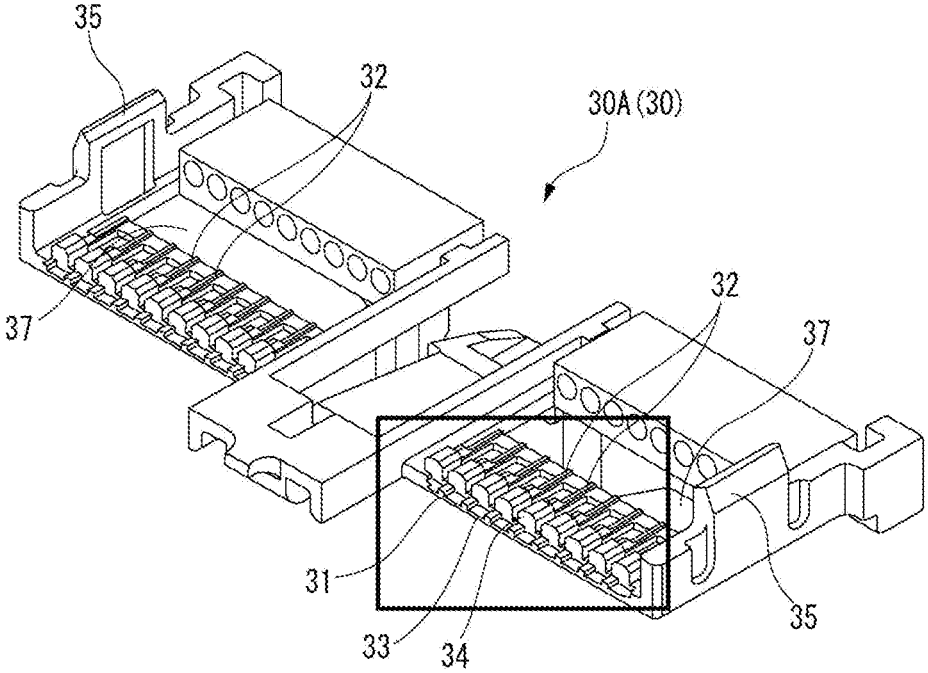
FIG. 14 is a perspective view of the reversed upper cover.

First, the upper cover 30A will be described with reference to FIGS. 13 to 15. FIG. 13 illustrates the upper cover 30A in the orientation of assembly to the housing main body 21, and FIG. 14 illustrates the reversed upper cover 30A.

The upper cover 30A includes a substantially flat plate-shaped cover main body 31. A plurality of standing walls 32 extending in the front-rear direction are integrally formed at intervals in the width direction on the lower surface of the front side part of the cover main body 31 so as to correspond to the standing walls 22 of the housing main body 21. Thus, when the upper cover 30A is assembled to the housing 20, the upper cover 30A closes the upper side of the rear side part of each of the terminal housing portions of the housing main body 21, so as to form the terminal housing portions having a cylindrical shape continuing in the front-rear direction in the front side part and the rear side part of each of the terminal housing portions.

A tapered surface 33 inclined forward and upward is formed at the front end edge of the cover main body 31 of the upper cover 30A. As will be described later, the tapered surface 33 is used when the upper cover 30A is assembled to the housing 20 (see FIG. 21).

Figure 15:
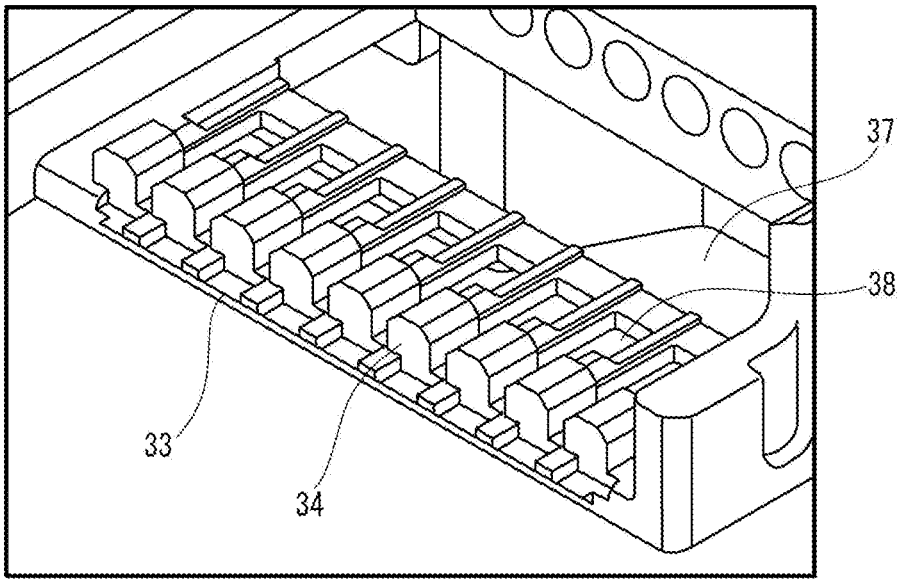
FIG. 15 is an enlarged view of the inside of the frame in FIG. 14.

As illustrated in FIG. 15, on the lower surface of the front end part of the cover main body 31 of the upper cover 30A, a plurality of projection portions 34 projecting downward are integrally formed at positions (positions between adjacent standing walls 32) of the plurality of terminal housing portions in the width direction. As will be described later, the projection portions 34 have a function of pressing the terminal 10 at the primary locking position forward to move the terminal 10 to the normal insertion position when the upper cover 30A is assembled to the housing 20.

Engaging portions 35, which are engaged with engaging portions 36 (see FIGS. 16 and 17) of the lower cover 30B when the upper cover 30A is assembled to the housing 20, are integrally formed at both end pans of the cover main body 31 of the upper cover 30A in the width direction.

In the central part of the cover main body 31 of the upper cover 30A in the front-rear direction, first through holes 37, which are continuous in the width direction, are formed across a plurality of the terminal housing portions. In the front side part (the part at the rear side of each of the projection portions 34) of the cover main body 31 of the upper cover 30A, a second through hole 38 extending in the front-rear direction is formed at a position (a position between adjacent standing walls 32) of each of the plurality of terminal housing portions in the width direction.

Figure 16:
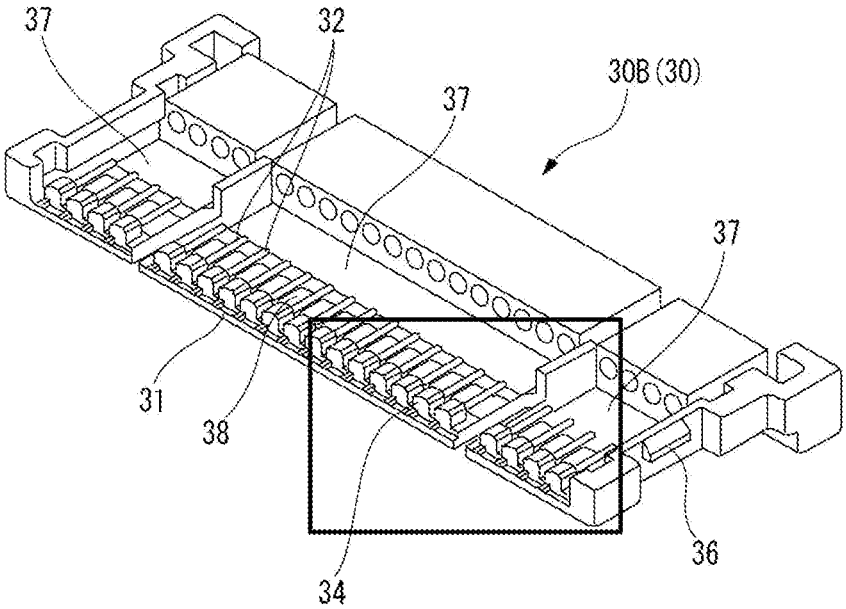
FIG. 16 is a perspective view of a lower cover illustrated in FIG. 2.
Figure 17:
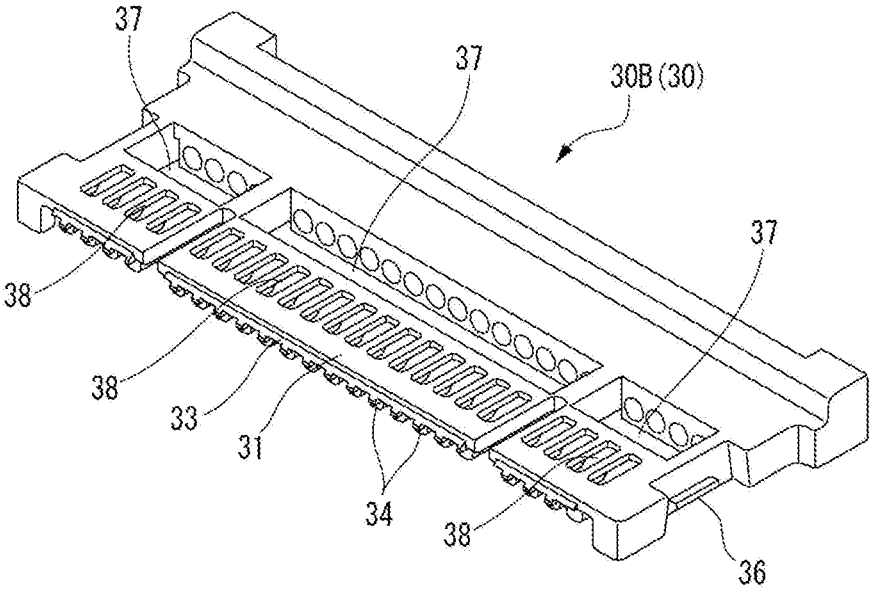
FIG. 17 is a perspective view of the reversed lower cover.
Figure 18:
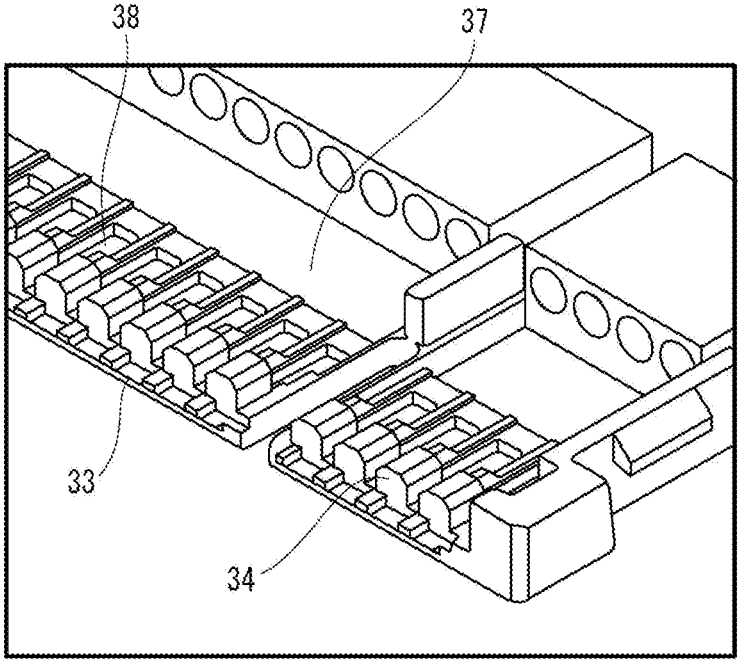
FIG. 18 is an enlarged view of the inside of the frame in FIG. 16.
Figure 19:
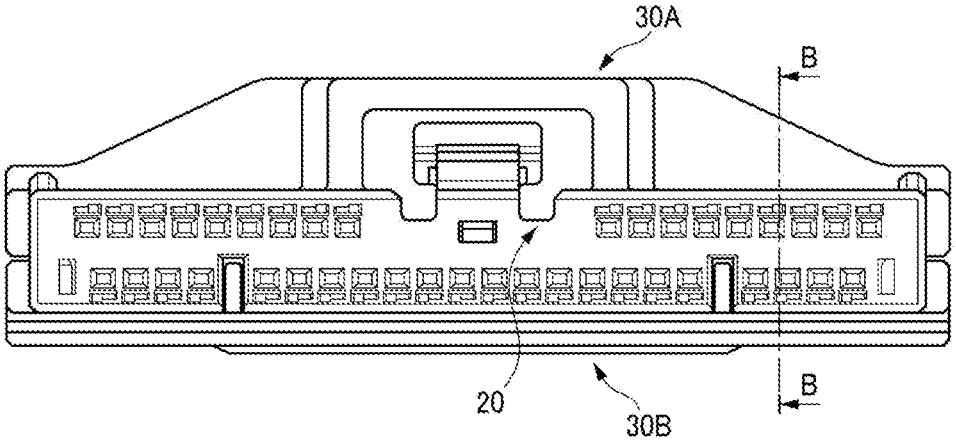
FIG. 19 is a front view of the connector illustrated in FIG. 1.

Next, the lower cover 30B will be described with reference to FIGS. 16 to 18. FIG. 16 illustrates the lower cover 30B in the orientation of the assembly to the housing main body 21, and FIG. 17 illustrates the reversed lower cover 30B. The configurations of the upper cover 30A and the lower cover 30B are slightly different from each other, but are substantially the same except that the upper cover 30A and the lower cover 30B are symmetrical in the upper-lower direction. Therefore, the lower cover 30B is denoted with the same reference numeral as the upper cover 30A with respect to the configuration corresponding to each configuration of the upper cover 30A, and the description thereof will be omitted.

Figure 20:
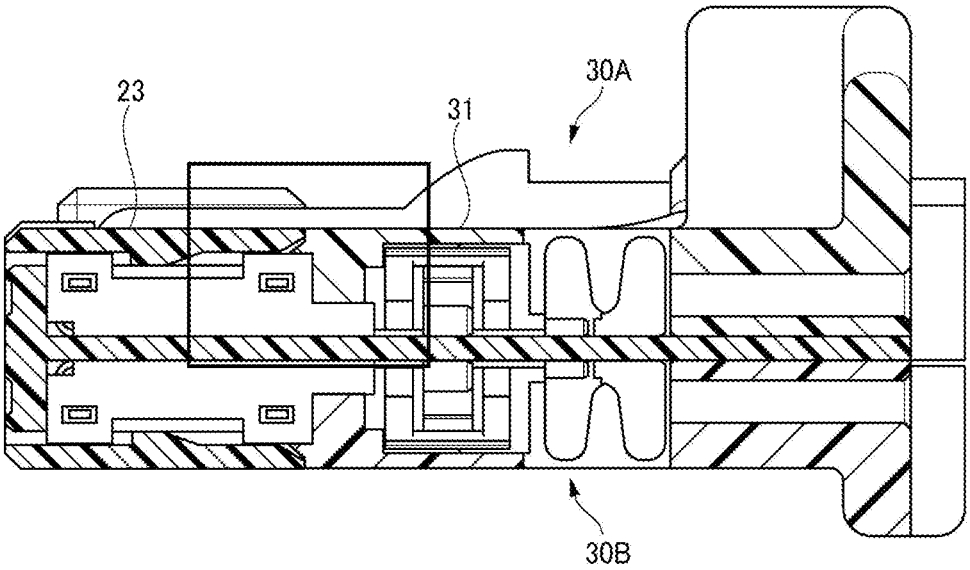
FIG. 20 is a cross-sectional view taken along a line B-B in FIG. 19.
Figure 21:
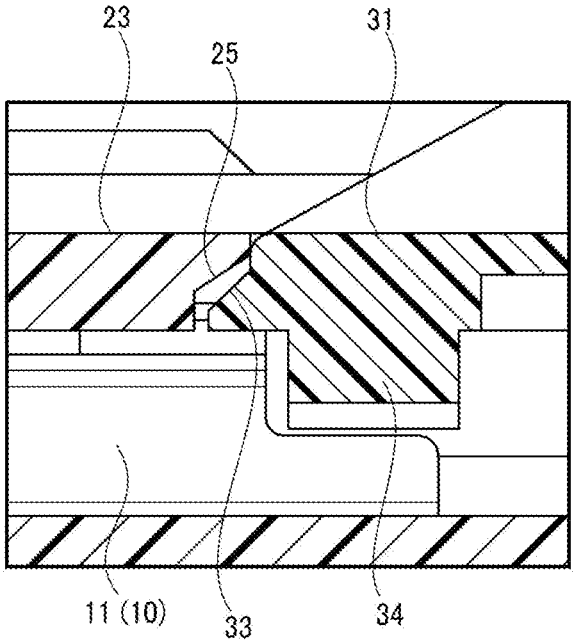
FIG. 21 is an enlarged view of the inside of the frame in FIG. 20.
Figure 22:
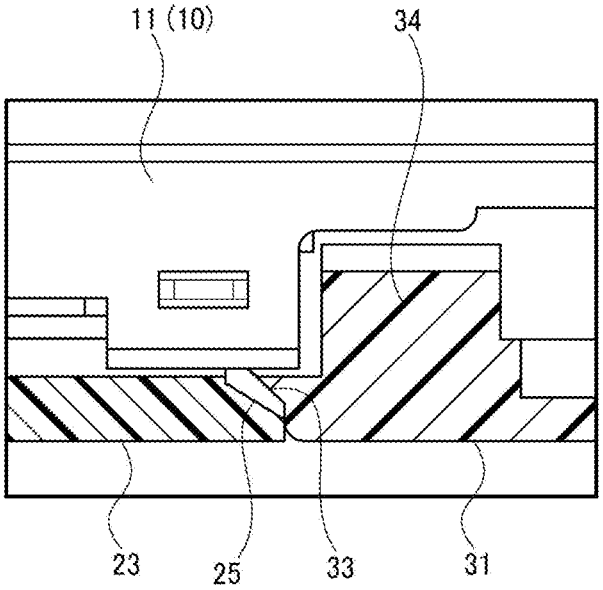
FIG. 22 is a view corresponding to FIG. 21 on a lower cover side.

As illustrated in FIGS. 19 to 22, when the upper cover 30A and the lower cover 30B are assembled to the housing 20, the front end edge of the upper cover 30A and the rear end edge of each of the top wall portions 23 on the upper surface side of the housing 20 are locked such that the tapered surface 33 of the front end edge of the upper cover 30A enters the lower side of the tapered surface 25 of the rear end edge of each of the top wall portions 23 on the upper surface side of the housing 20 (see FIG. 21). The front end edge of the lower cover 30B and the rear end edge of each of the top wall portions 23 on the lower surface side of the housing 20 are locked such that the tapered surface 33 of the front end edge of the lower cover 30B enters the upper side of the tapered surface 25 of the rear end edge of each of the top wall portions 23 on the lower surface side of the housing 20 (see FIG. 22). A plurality of the engaging portions 35 of the upper cover 30A and a plurality of the engaging portions 36 of the lower cover 30B are locked to one another. By the cooperation, each of the upper cover 30A and the lower cover 30B is assembled to the housing 20 so as not to move relative to the housing 20, and the upper cover 30A and the lower cover 30B are assembled to each other so as not to move relative to each other.

Figure 23:
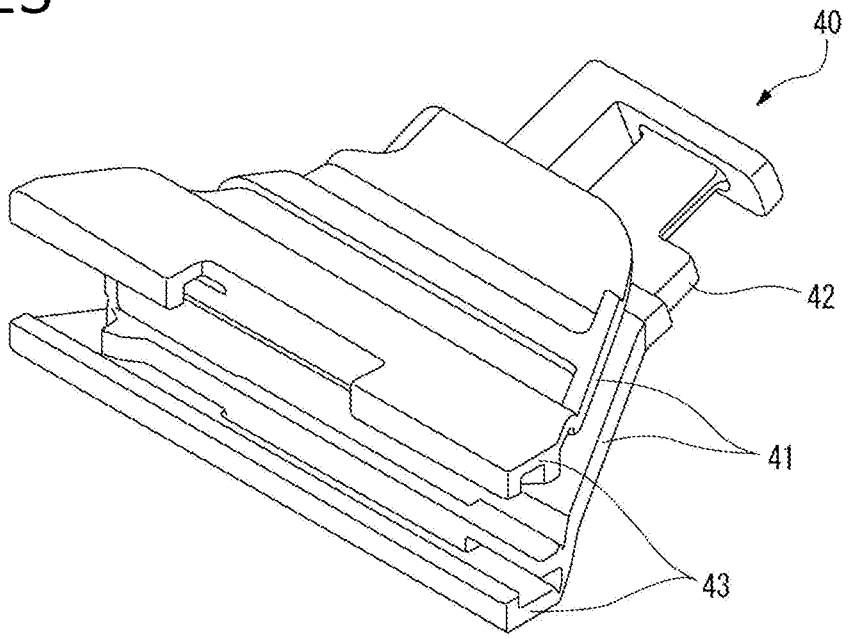
FIG. 23 is a perspective view of a connector cover illustrated in FIG. 2.

Next, the connector cover 40 will be described with reference to FIG. 23. The connector cover 40 includes a pair of plate-shaped electric wire housing portions 41 which are disposed to face each other in the upper-lower direction and an electric wire holding portion 42 which is integrally extended and formed on the rear side of the lower electric wire housing portion 41. The connector cover 40 is fixed to the housing 20 (see FIG. 40) so as to project to the rear side from the rear end surface of the housing 20 by attaching an engaging portion 43 provided on the front side end part of each of the pair of electric wire housing portions 41 to an engaging portion (not illustrated) provided on the rear side end part of each of the upper cover 30A and the lower cover 30B that are assembled to the housing 20.

The pair of electric wire housing portions 41 has a function of housing and protecting a plurality of the electric wires W extending rearward from a plurality of the terminals 10 housed in a plurality of the terminal housing portions. The electric wire holding portion 42 is used to bundle and hold a plurality of the electric wires extending rearward from the housing 20. The plurality of the electric wires W extending rearward from the housing 20 are held by the electric wire holding portion 42 so as to be bundled using a tie band or the like (not illustrated).

Figure 24:
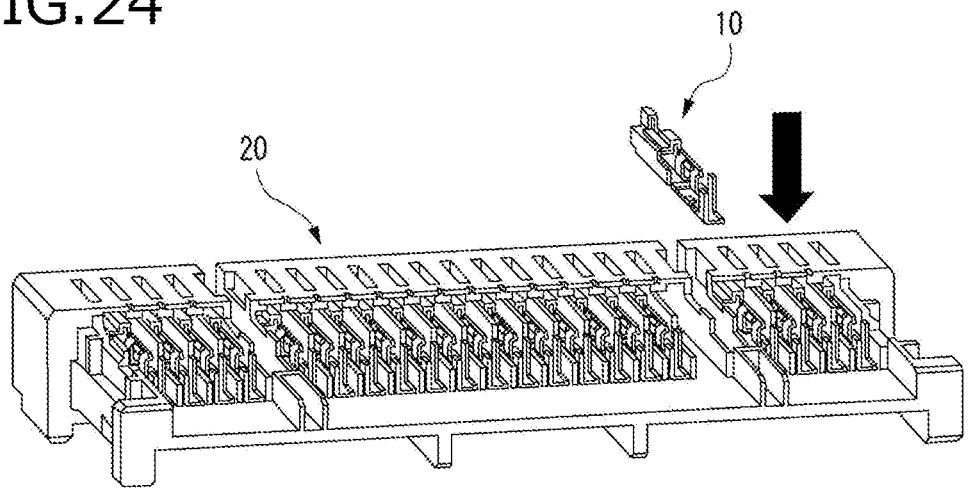
FIG. 24 is a first view illustrating a procedure of assembling the connector.

Next, a procedure of assembling the connector 1 will be described with reference to FIGS. 24 to 40. First, as illustrated in FIG. 24, each of the terminals 10 is disposed on the rear side part, whose upper side is opened, of the predetermined terminal housing portion on the upper surface side (the lower surface side in the normal orientation) of the reversed housing 20 by using a predetermined device, and the predetermined portion (typically, the rear end surface of the rectangular tubular connecting portion 11) of the terminal 10 is pushed forward to the primary locking position illustrated in FIGS. 11 and 12. As a result, the protruding portion 14 of each of the terminals 10 is engaged with the lance 26 of the housing 20, so that the terminals 10 inserted into the terminal housing portions can be prevented from coming off from the housing 20.

Figure 25:
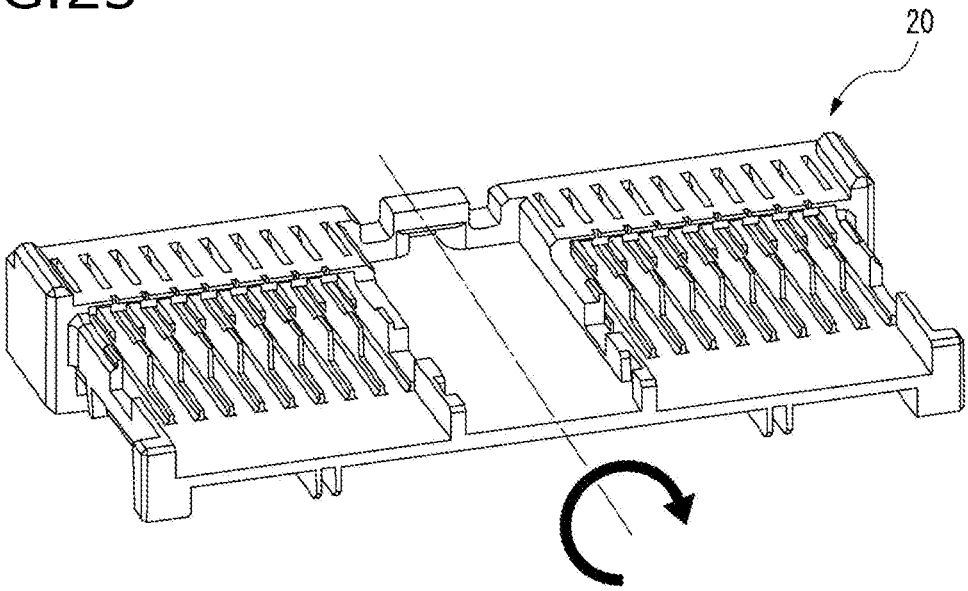
FIG. 25 is a second view illustrating the procedure of assembling the connector.
Figure 26:
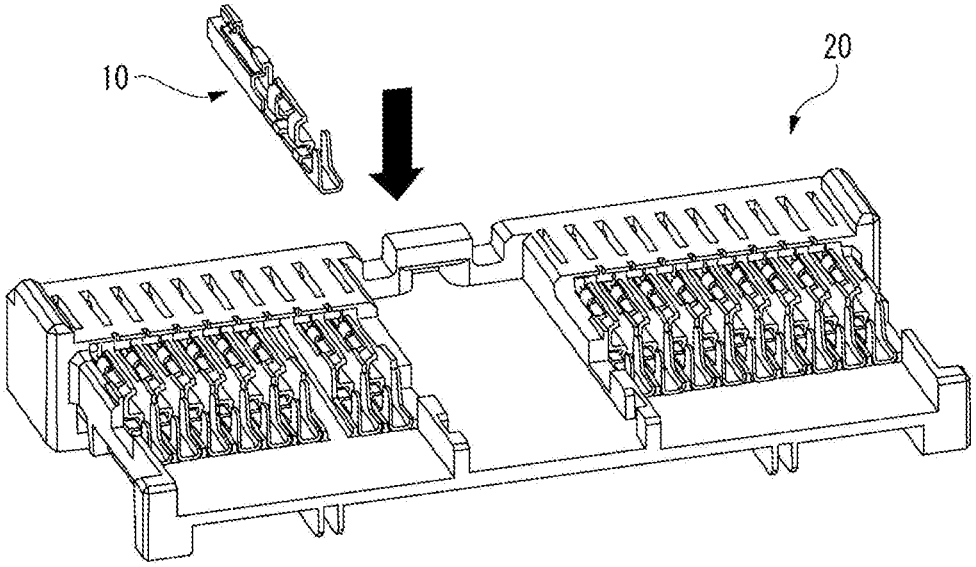
FIG. 26 is a third view illustrating the procedure of assembling the connector.

Next, as illustrated in FIG. 25, the housing 20 is reversed. Accordingly, the orientation of the housing 20 is the normal orientation. In this state, similarly to the procedure illustrated in FIG. 24, the terminals 10 are respectively inserted into the predetermined terminal housing portions on the upper surface side of the housing 20 to the primary locking positions, as illustrated in FIG. 26.

Figure 27:
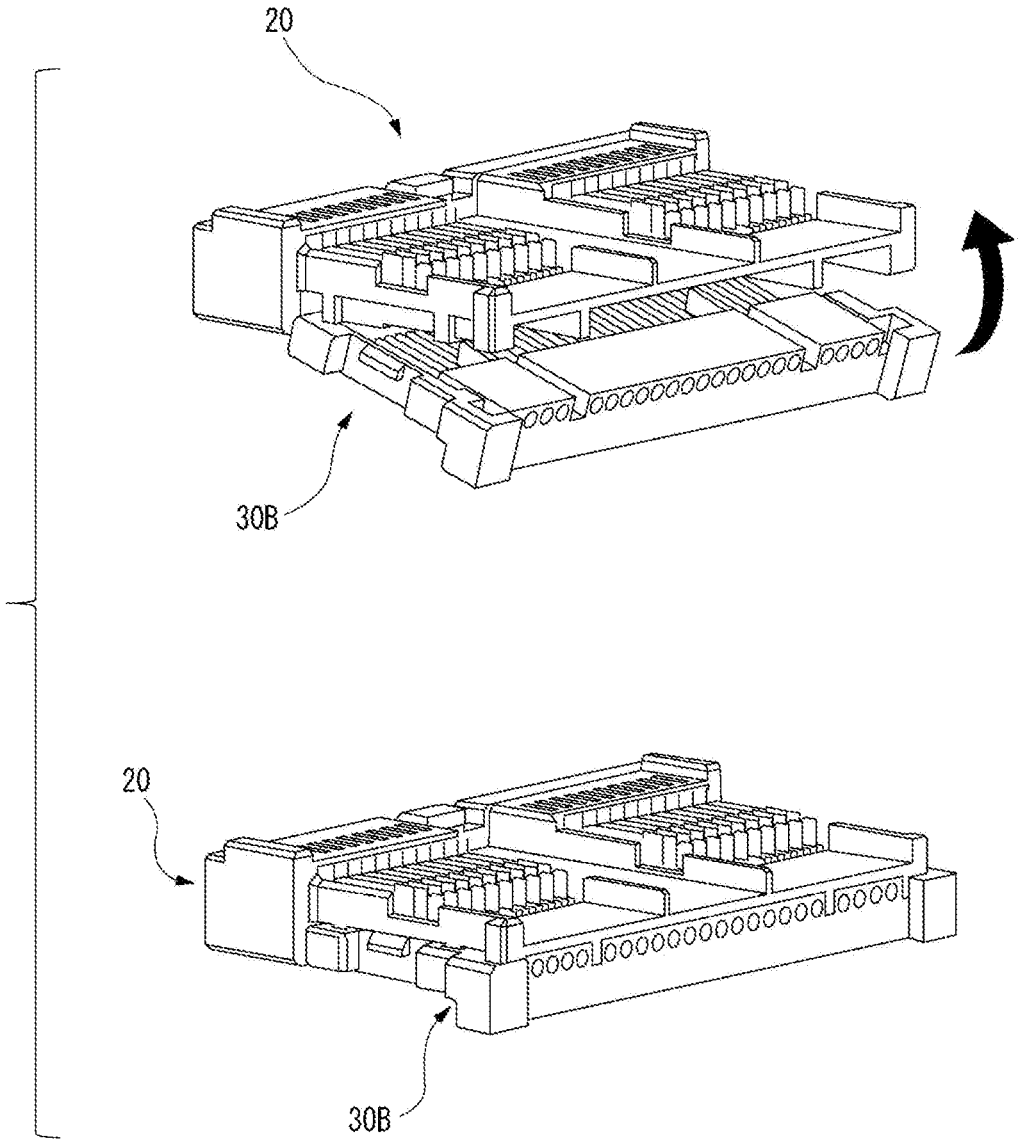
FIG. 27 is a fourth view illustrating the procedure of assembling the connector.
Figure 28:
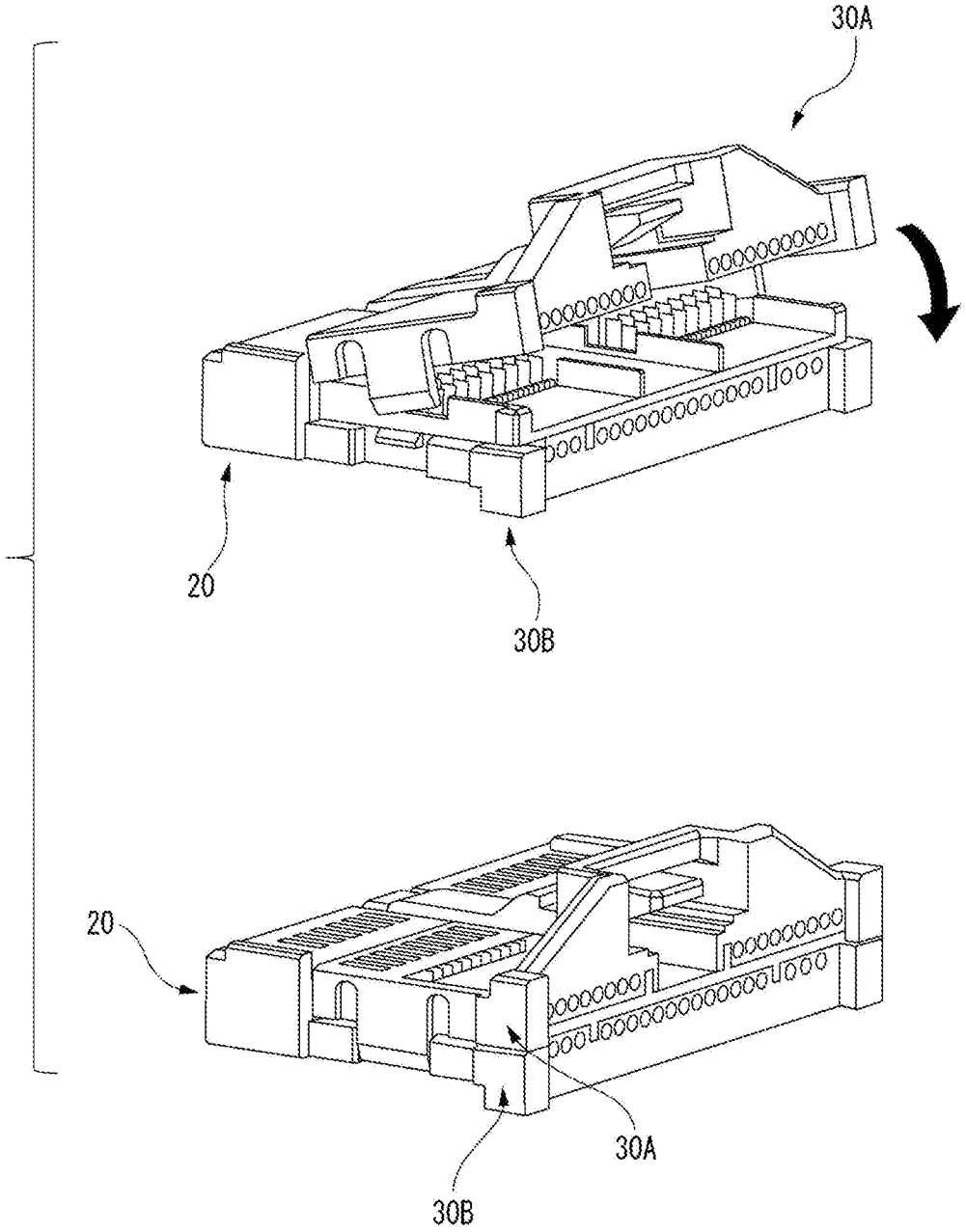
FIG. 28 is a fifth view illustrating the procedure of assembling the connector.
Figure 29:
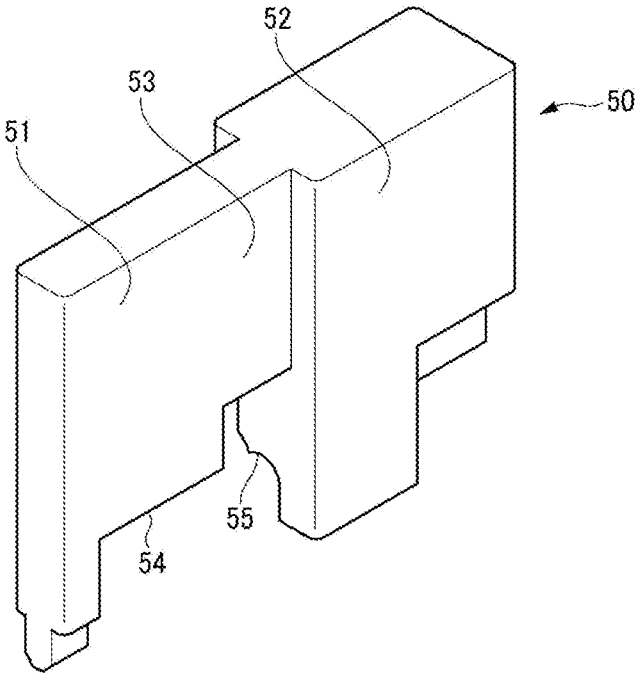
FIG. 29 is a perspective view of a jig which is configured to deform an elastic deformation portion of the conductor fixing portion of the terminal

Next, as illustrated in FIG. 27, the lower cover 30B is assembled to the housing 20, and then, as illustrated in FIG. 28, the upper cover 30A is assembled to the housing 20. The procedure of assembling the upper cover 30A to the housing 20 and the procedure of assembling the lower cover 30B to the housing 20 are substantially the same except that the upper cover 30A and the lower cover 30B are symmetrical in the upper-lower direction. Therefore, only the procedure of assembling the upper cover 30A to the housing 20 will be described below.

When the terminal 10 inserted into the terminal housing portion is in the primary locking position, first, the front end edge of the upper cover 30A (the cover main body 31) is brought close to the rear end edge of each of the top wall portions 23 of the housing 20 and the projection portions 34 of the upper cover 30A is abutted against the rear end of each of the connecting portions 11 of the terminals 10 while the rear side of the upper cover 30A is maintained to be inclined upward from the front side.

Next, the upper cover 30A is moved forward in parallel to the housing 20 until the tapered surface 33 of the front end edge of the upper cover 30A enters below the tapered surface 25 of the rear end edge of each of the top wall portions 23 (until the front end edge of the upper cover 30A is engaged with the rear end edge of each of the top wall portions 23) while this state (that is, the state where the upper cover 30A is inclined and the projection portions 34 abut against the connecting portions 11 of the terminals 10) is maintained. At this time, the terminals 10 move from the primary locking positions to the normal insertion positions along with the forward movement of the upper cover 30A by the pressing of the projection portions 34.

Then, while the front end edge of the upper cover 30A is maintained to be engaged with the rear end edge of each of the top wall portions 23, the inclined upper cover 30A is pivoted in an orientation in which the rear side of the upper cover 30A approaches the housing 20 with the front end side of the upper cover 30A as a fulcrum. Accordingly, a plurality of the engaging portions 35 of the upper cover 30A and a plurality of the engaging portions 36 of the lower cover 30B are engaged with one another so that the upper cover 30A and the lower cover 30B are assembled to the housing 20, as illustrated in FIG. 20.

When the upper cover 30A is assembled to the housing 20, the projection portions 34 of the upper cover 30A are in surface contact with or close to the rear end surfaces of the connecting portions 11 of the terminals 10. Therefore, the terminals 10 are prevented from coming off from the housing 20. That is, in addition to the engagement of the protruding portions 14 and the lances 26 of the terminals 10, a so-called double lock state is obtained by the engagement between the connecting portions 11 of the terminals 10 and the projection portions 34.

As described above, the upper cover 30A is designed to be attached to the housing 20 in the normal state only by pivoting the inclined upper cover 30A with the front end side of the upper cover 30A as the fulcrum. Even when the upper cover 30A is moved in parallel to the housing 20 downward from the upper side while being maintained to be in parallel to the housing 20 so as to be assembled to the housing 20, the front end edge of the upper cover 30A and the rear edge of each of the top wall portions 23 interfere with each other, so that the upper cover 30A cannot be assembled.

As described above, when the upper cover 30A and the lower cover 30B are assembled to the housing 20, the electric wires W are then connected to the plurality of terminals 10 which are housed in the housing 20. Therefore, first, a jig 50 is inserted downward from the upper side into the second through hole 38 of one terminal housing portion among the plurality of terminal housing portions in which the terminals 10 are housed. First, the jig 50 will be described below with reference to FIGS. 29 to 31.

The jig 50 is a metal member that integrally includes a pressing portion 51, a guide portion 52 which is disposed side by side with the pressing portion 51, and a connecting portion 53 which connects the pressing portion 51 and the guide portion 52. The jig 50 generally has a plate shape extending in the front-rear direction and is inserted into the second through hole 38 in an orientation in which the pressing portion 51 and the guide portion 52 are located on the front side and the rear side, respectively.

The pressing portion 51 functions to press the elastic deformation portion 12*b* (more specifically, the connecting portion 17) of the terminal 10 housed in the terminal housing portion downward from the upper side. When the pressing portion 51 is pressed downward with respect to the elastic deformation portion 12*b*, the pressing surface (the flat surface) 54, which is located at the bottom part of the pressing portion 51 and is configured to press the elastic deformation portion 12*b*, is inclined rightward as viewed from the front with respect to the horizontal surface such that the elastic deformation portion 12*b* is deformed to the right as viewed from the front (the front side) (see FIG. 31).

Figure 34:
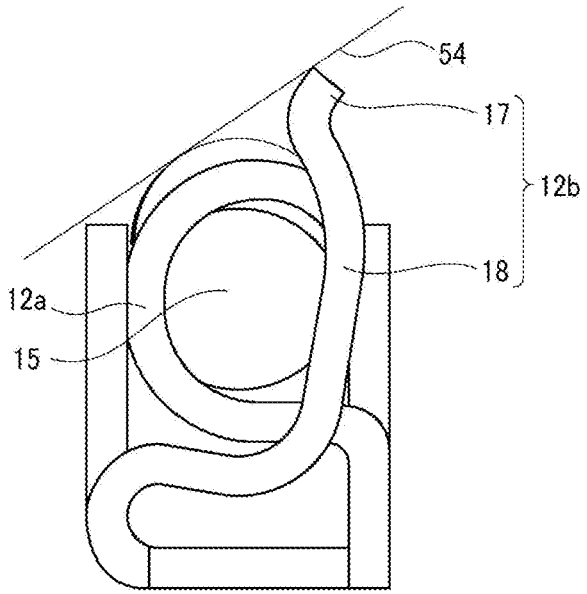
FIG. 34 is a view corresponding to FIG. 5 in a state illustrated in FIG. 33.

Therefore, when the elastic deformation portion 12*b* (the connecting portion 17) is pressed downward from the upper side by the pressing surface 54 of the pressing portion 51, the pair of elastic pieces 18 are moved from the "initial position" (see FIG. 5) to the "deformed position" (see FIG. 34).

The guide portion 52 functions to guide the conductor core wire W1 of the electric wire W toward the insertion portion 15 of the terminal 10. A projection portion 55, which is configured to guide the conductor core wire W1 toward the center of the insertion portion 15, is provided at the end part on the front side (the side closer to the pressing portion 51) of a guide surface which is located at the bottom part of the guide portion 52 and is configured to guide the conductor core wire W1 toward the insertion portion 15. The jig 50 has been described above.

Figure 32:
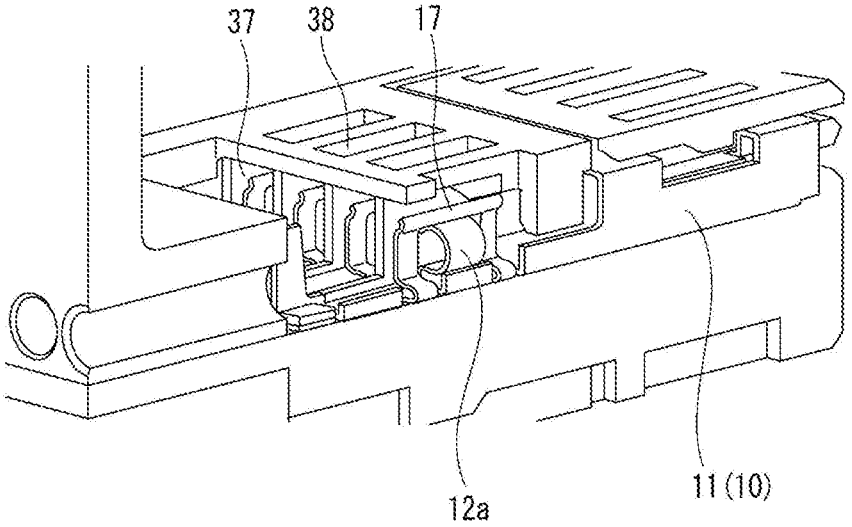
FIG. 32 is a first view illustrating a procedure of connecting the electric wire to the terminal.

As illustrated in FIGS. 32 and 5, the pair of elastic pieces 18 of the elastic deformation portion 12*b* of the terminal 10 is at the "initial position" before the jig 50 having this shape is inserted into the second through hole 38. Therefore, the conductor core wire W1 of the electric wire W cannot be inserted through the insertion portion 15.

In this state, when the jig 50 is inserted downward from the upper side into the corresponding second through hole 38, the pressing surface 54 of the jig 50 abut against the connecting portion 17 of the elastic deformation portion 12*b* of the corresponding terminal 10.

Figure 33:
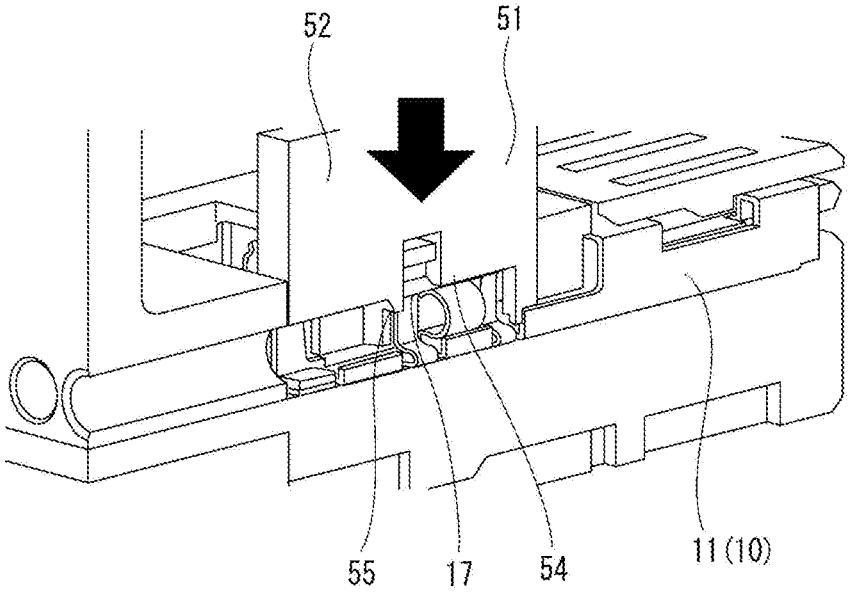
FIG. 33 is a second view illustrating the procedure of connecting the electric wire to the terminal.

In this state, the jig 50 is pressed downward. Accordingly, the connecting portion 17 is pressed downward, so that the pair of elastic pieces 18 move from the "initial position" to the "deformed position", as illustrated in FIGS. 33 and 34. That is, the conductor core wire W1 of the electric wire W can be inserted through the insertion portion 15.

Next, the electric wire W is inserted from the rear end opening of the corresponding terminal housing portion. The terminal processing of removing the cover W2 of the front end part of the electric wire W is performed in advance on the electric wire W. Therefore, the front end part of the conductor core wire W1 of the electric wire W is exposed.

Figure 35:
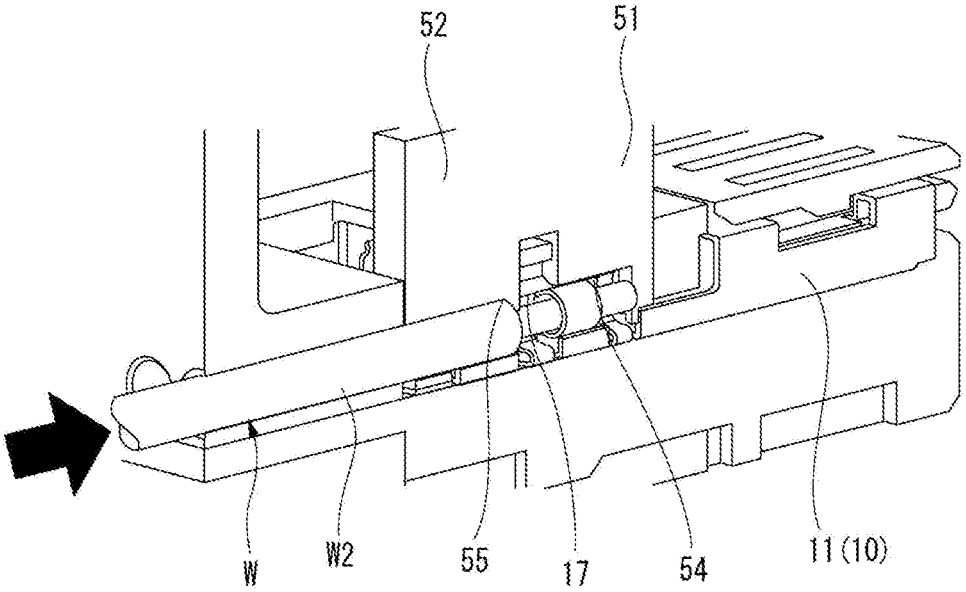
FIG. 35 is a third view illustrating the procedure of connecting the electric wire to the terminal.
Figure 36:
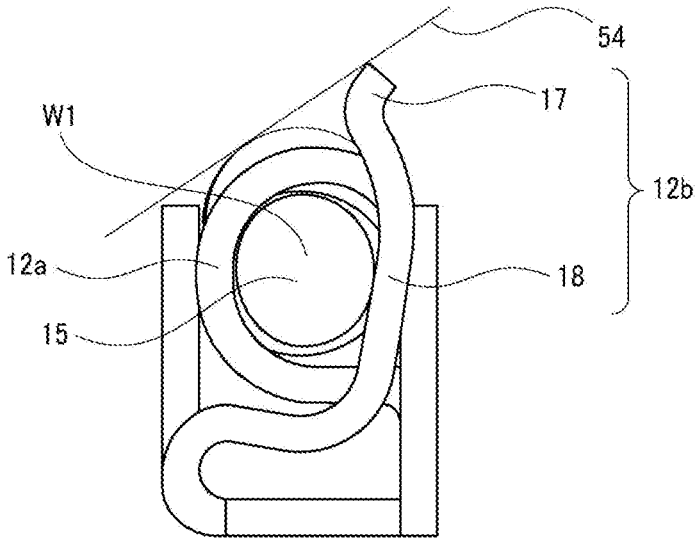
FIG. 36 is a view corresponding to FIG. 5 in a state illustrated in FIG. 35.

Thus, by inserting the electric wire W, the conductor core wire W1 exposed at the front end part of the electric wire W is guided by the guide surface of the guide portion 52 of the jig 50, and is inserted through the insertion portion 15 as illustrated in FIGS. 35 and 36 while being guided toward the center of the insertion portion 15 by the projection portion 55.

Figure 37:
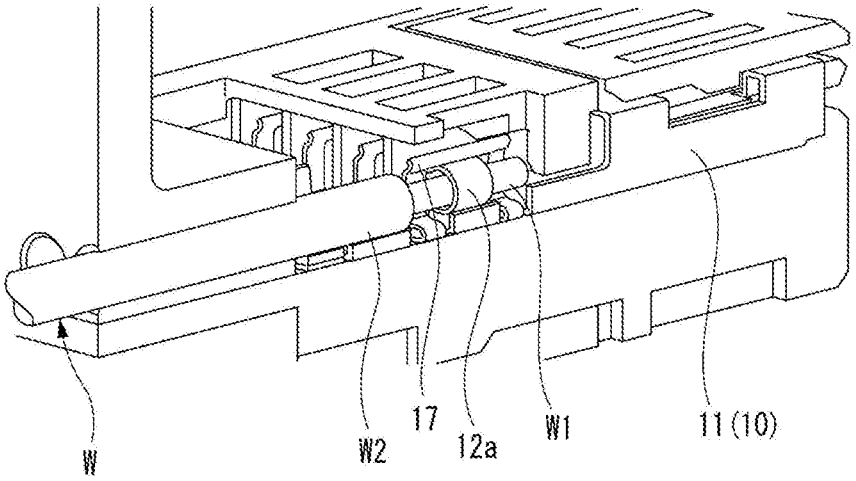
FIG. 37 is a fourth view illustrating the procedure of connecting the electric wire to the terminal.
Figure 38:
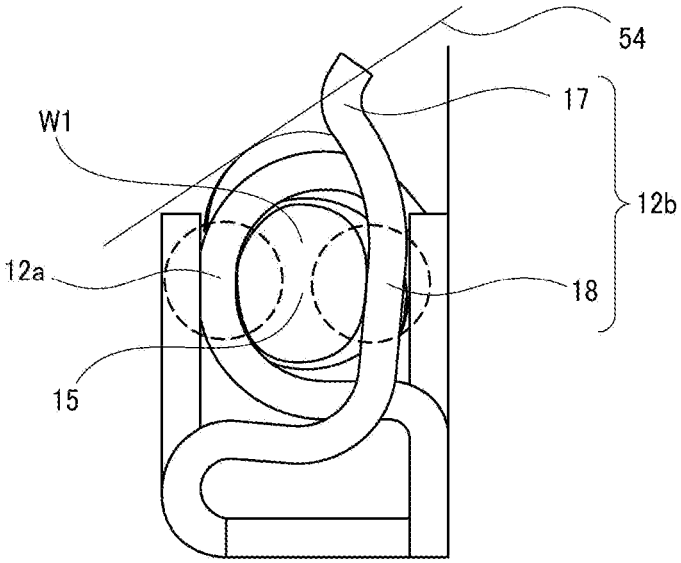
FIG. 38 is a view corresponding to FIG. 5 in a state illustrated in FIG. 37.
Figure 39:
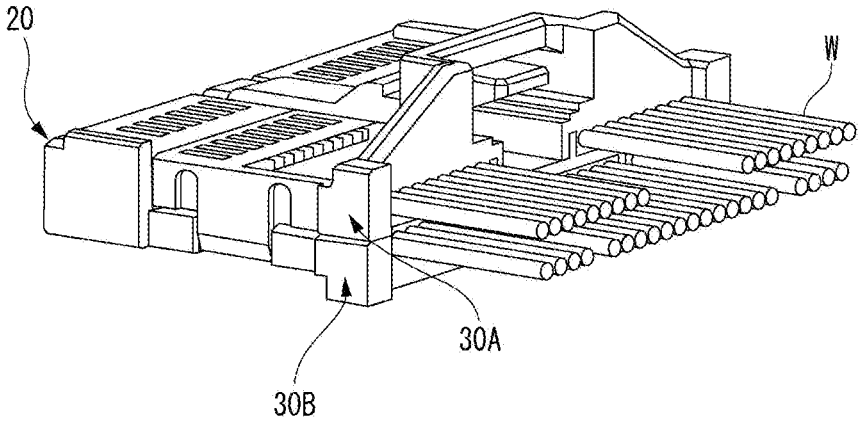
FIG. 39 is a sixth view illustrating the procedure of assembling the connector.

Next, from this state, the jig 50 is extracted from the second through hole 38. Accordingly, the press to the elastic deformation portion 12*b* by the pressing surface 54 is released. Therefore, the conductor core wire W1 is sandwiched between the holding portion 12*a* and the pair of elastic pieces 18 in the width direction by the elastic restoring force of the pair of elastic pieces 18, as illustrated in FIGS. 37 and 38. As a result, the conductor core wire W1 is fixed to and is electrically connected to the conductor fixing portion 12 of the terminal 10.

Next, a crimping jig (not illustrated) is inserted downward from the upper side into the corresponding position of the first through hole 37. Accordingly, the lower end surface of the crimping jig abuts against the pair of crimping pieces 16 of the cover fixing portion 13 of the corresponding terminal 10. Next, in this state, the crimping jig is pressed downward. Accordingly, the pair of crimping pieces 16 are pressed downward, so that the cover W2 of the electric wire W is crimped by the pair of crimping pieces 16 and is fixed to the cover fixing portion 13.

Accordingly, the connection of the electric wire W to the corresponding terminal 10 is completed. Thereafter, as illustrated in FIG. 35, the above-described connection operation of the electric wires W is repeatedly performed for all the remaining terminal housing portions in which the terminals 10 are housed.

Figure 40:
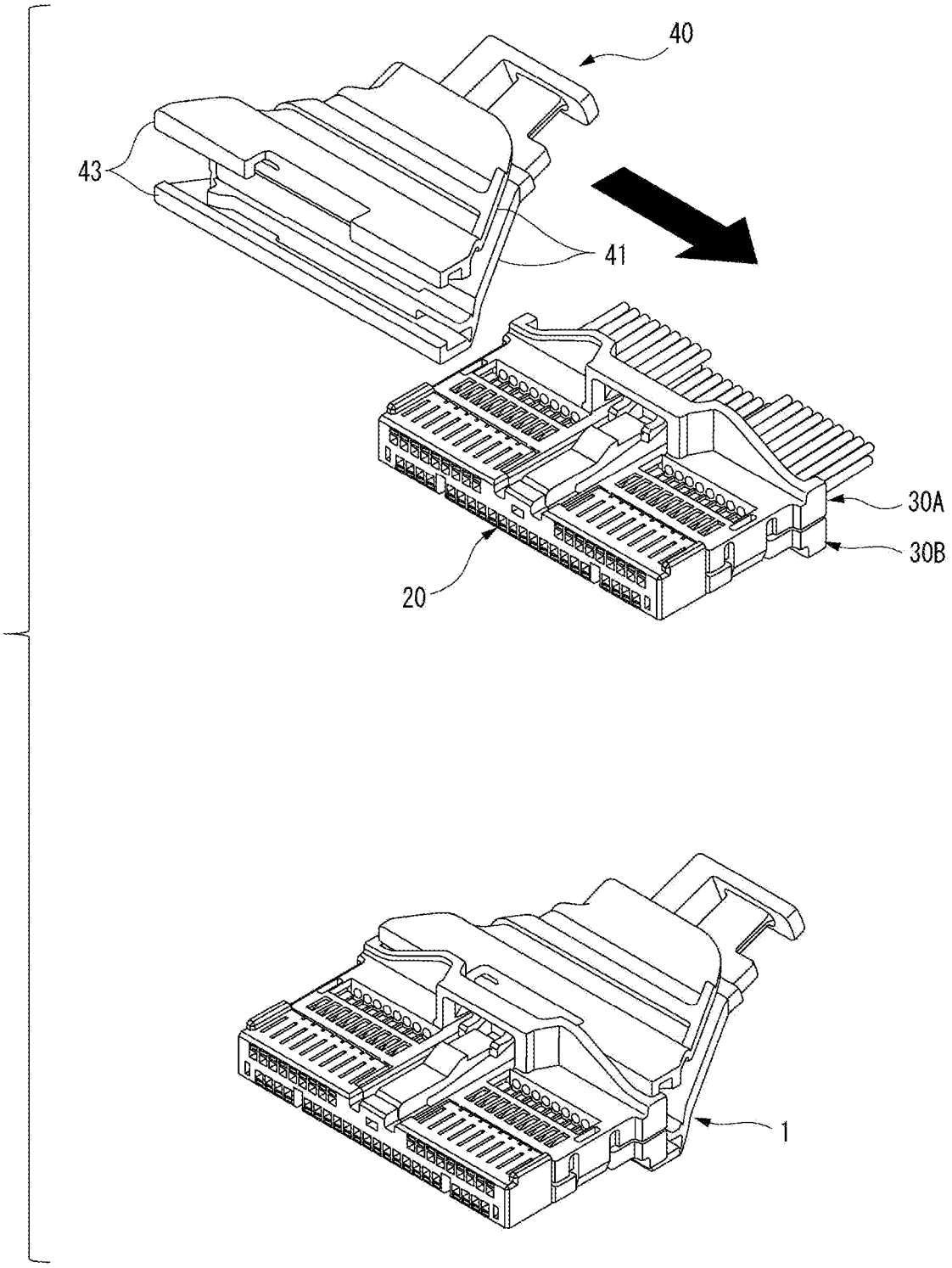
FIG. 40 is a seventh view illustrating the procedure of assembling the connector.

When the connection operation of the electric wires W is completed for all of the terminal housing portions in which the terminals 10 are housed, the connector cover 40 is attached to the housing 20 as illustrated in FIG. 40. Specifically, the connector cover 40 is fixed to the housing 20 so as to project rearward from the rear end surface of the housing 20 by attaching the engaging portion 43 of each of the pair of electric wire housing portions 41 to the engaging portion on the rear side end part of each of the upper cover 30A and the lower cover 30B that are assembled to the housing 20.

Finally, a plurality of the electric wires W extending rearward from the connector cover 40 are held by the electric wire holding portion 42 so as to be bundled using a tie band or the like (not illustrated). Accordingly, the assembly of the connector 1 is completed.

As described above, according to the terminal 10 in the embodiment of the present invention, when the electric wires W are connected to the terminals 10 after the terminals 10 are housed in the terminal housing portions of the housing 20, the elastic deformation portion 12*b* is at the deformed position by the application of an external force and the conductor core wire W1 is inserted through the insertion portion 15. In this state, the conductor core wire W1 of the electric wire W can be fixed to the terminal 10 only by releasing the application of the external force. Therefore, even after the terminals 10 are housed in the terminal housing portions of the housing 20, the electric wires W can be extremely easily connected to the terminals 10.

Further, the conductor core wire W1 is sandwiched at two different places in the extending direction by the holding portion 12*a* and the pair of elastic pieces 18. Therefore, the conductor core wire W1 of the electric wire W can be more firmly fixed to the terminal 10 as compared with an aspect in which the conductor core wire W1 is sandwiched only at one place in the extending direction.

According to the jig 50 in the embodiment of the present invention, the pressing surface 54 of the pressing portion 51 is inclined to the other side in the width direction with respect to the horizontal plane. Therefore, the elastic deformation portion 12*b* can be reliably elastically deformed to the other side in the width direction only by moving the pressing portion 51 downward from the upper side.

The projection portion 55 is provided on the guide surface of the guide portion 52, so that the front end of the conductor core wire W1 can be reliably guided into the insertion portion 15 by inserting the conductor core wire W1 into the insertion portion 15 while sliding the front end of the conductor core wire W1 on the guide surface of the guide portion 52.

Other Embodiments

The present invention is not limited to the above embodiment, and various modifications can be used within the scope of the present invention. For example, the present invention is not limited to the above-described embodiment and can be appropriately modified, improved or the like. In addition, the material, the shape, the size, the number, the arrangement position or the like of each component in the above-described embodiment are optional and are not limited as long as the present invention can be achieved.

In the above-described embodiment, the elastic deformation portion 12*b* of the terminal 10 is formed by the connecting portion 17 and the pair of elastic pieces 18, but may be formed by only a single elastic piece 18. In this case, the conductor core wire W1 is sandwiched between the holding portion 12*a* and the single elastic piece 18 at one place in the extending direction.

In the above-described embodiment, the female terminal is used as the terminal 10. However, a male terminal may be used as the terminal 10. In this case, the connecting portion 11 of the terminal 10 has a tab shape instead of the rectangular tubular shape.

Here, characteristics of the terminal 10, the method of connecting an electric wire to the terminal 10, and the jig 50 according to the embodiment of the present invention described above will be summarized briefly and listed in the following [1] to [5].

[1] A terminal (10) configured to be connected to a front end of an electric wire (W) having a conductor core wire (W1) and a cover (W2) covering the conductor core wire (W1), and which extends in a front-rear direction, the terminal (10) including:

a connecting portion (11) configured to be connected to a mating terminal;

a cover fixing portion (13) which is located rearward of the connecting portion (11) and is configured to fix the cover (W2) of the electric wire (W); and a conductor fixing portion (12) which is located between the connecting portion (11) and the cover fixing portion (13) and is configured to fix the conductor core wire (W1) exposed from the cover of the electric wire (W), in which the connecting portion (11), the cover fixing portion (13) and the conductor fixing portion (12) are integrally formed of a single material and are formed of a plate-shaped member;

in which the conductor fixing portion (12) includes:

a holding portion (12*a*) which has an insertion portion (15) through which the conductor core wire (W1) is inserted and is configured to hold at least one side of the conductor core wire (W1) inserted into the insertion portion (15) in a width direction of the conductor core wire (W1); and an elastic deformation portion (12*b*) which does not allow the conductor core wire (W1) to be inserted through the insertion portion (15) by interference between the elastic deformation portion (12*b*) and the conductor core wire (W1) when the elastic deformation portion (12*b*) is at an initial position and which allows the conductor core wire (W1) to be inserted through the insertion portion (15) when the elastic deformation portion (12*b*) is at a deformed position where the elastic deformation portion (12*b*) is elastically deformed from the initial position to the other side opposite to the one side in the width direction, the elastic deformation portion (12*b*) being disposed at a position different from the holding portion (12*a*) in the front-rear direction and being elastically deformable in the width direction;

in which the holding portion (12*a*) and the elastic deformation portion (12*b*) are integrally formed of a single material; and in which the elastic deformation portion (12*b*) is at the deformed position by application of an external force and then the application of the external force is released in a state that the conductor core wire (W1) is inserted through the insertion portion (15), so that the conductor core wire (W1) is fixed by the conductor fixing portion (12) by being sandwiched between the holding portion (12*a*) and the elastic deformation portion (12*b*) in the width direction by an elastic restoring force of the elastic deformation portion (12*b*).

[2] The terminal 10 according to [1], in which the elastic deformation portion (12*b*) includes:

a pair of elastic pieces (18) which do not allow the conductor core wire (W1) to be inserted through the insertion portion (15) by interference between the pair of elastic pieces (18) and the conductor core wire (W1) when the pair of elastic pieces (18) is at the initial position and which allow the conductor core wire (W1) to be inserted through the insertion portion (15) when the pair of elastic pieces (18) is at the deformed position, the pair of elastic pieces (18) being disposed forward and rearward from the holding portion (12*a*) in the front-rear direction and being elastically deformable in the width direction; and a connecting portion (17) which connects extended end parts of the pair of elastic pieces (18) to each other and extends in the front-rear direction; and in which the pair of elastic pieces (18) are at the deformed position by application of an external force to the connecting portion (17) and then the application of the external force is released in a state that the conductor core wire (W1) is inserted through the insertion portion (15), so that the conductor core wire (W1) is fixed by the conductor fixing portion (12) by being sandwiched between the holding portion (12*a*) and the pair of elastic pieces (18) in the width direction by an elastic restoring force of the pair of elastic pieces (18).

[3] A method of connecting the electric wire (W) to the terminal (10) according to [1] or [2], the method including:

housing the terminal (10) in a terminal housing portion of a housing (20);

applying an external force to the elastic deformation portion (12*b*) of the terminal (10) housed in the terminal housing portion to maintain the elastic deformation portion (12*b*) at the deformed position;

inserting the conductor core wire (W1) through the insertion portion (15) in a state that the elastic deformation portion (12*b*) is kept at the deformed position by applying the external force; and fixing the conductor core wire (W1) to the conductor fixing portion (12) by releasing the application of the external force in a state that the conductor core wire (W1) is inserted through the insertion portion (15) and sandwiching the conductor core wire (W1) between the holding portion (12*a*) and the elastic deformation portion (12*b*) in the width direction by an elastic restoring force of the elastic deformation portion (12*b*).

[4] A jig (50) used in the method according to [3], the jig including:

a pressing portion (51) configured to press the elastic deformation portion (12*b*) of the terminal (10) housed in the terminal housing portion downward from a upper side, in which, when the pressing portion (51) is pressed downward with respect to the elastic deformation portion (12*b*), a pressing surface (54) of the pressing portion, which is located at a bottom part of the pressing portion (51) and is configured to press the elastic deformation portion (12*b*), is inclined to the other side in the width direction with respect to a horizontal surface such that the elastic deformation portion (12*b*) is deformed to the other side.

[5] The jig (50) according to [4], further including:

a guide portion (52) which is located side by side with the pressing portion (51) and is configured to guide the conductor core wire (W1) toward the insertion portion (15), in which the guide portion (52) and the pressing portion (51) are integrally formed of a single material; and in which a protruding portion (55), which is configured to guide the conductor core wire (W1) toward a center of the insertion portion (15), is provided on a guide surface which is located at a bottom part of the guide portion (52) and is configured to guide the conductor core wire (W1) toward the insertion portion (15).

What is claimed is:

1. A terminal configured to be connected to a front end of an electric wire having a conductor core wire and a cover covering the conductor core wire, and which extends in a front-rear direction, the terminal comprising:

a connecting portion configured to be connected to a mating terminal;

a cover fixing portion which is located rearward of the connecting portion and is configured to fix the cover of the electric wire; and a conductor fixing portion which is located between the connecting portion and the cover fixing portion and is configured to fix the conductor core wire exposed from the cover of the electric wire, wherein the connecting portion, the cover fixing portion and the conductor fixing portion are integrally formed and are formed of a plate-shaped member;

wherein the conductor fixing portion comprises:

a holding portion which has an insertion portion through which the conductor core wire is inserted and is configured to hold at least one side of the conductor core wire inserted into the insertion portion in a width direction of the conductor core wire; and an elastic deformation portion which does not allow the conductor core wire to be inserted through the insertion portion by interference between the elastic deformation portion and the conductor core wire when the elastic deformation portion is at an initial position and which allows the conductor core wire to be inserted through the insertion portion when the elastic deformation portion is at a deformed position where the elastic deformation portion is elastically deformed from the initial position to the other side opposite to the one side in the width direction, the elastic deformation portion being disposed at a position different from the holding portion in the front-rear direction and being elastically deformable in the width direction;

wherein the holding portion and the elastic deformation portion are integrally formed; and wherein the elastic deformation portion is at the deformed position by application of an external force and then the application of the external force is released in a state that the conductor core wire is inserted through the insertion portion, so that the conductor core wire is fixed by the conductor fixing portion by being sandwiched between the holding portion and the elastic deformation portion in the width direction by an elastic restoring force of the elastic deformation portion.

2. The terminal according to claim 1, wherein the elastic deformation portion comprises:

a pair of elastic pieces which do not allow the conductor core wire to be inserted through the insertion portion by interference between the pair of elastic pieces and the conductor core wire when the pair of elastic pieces is at the initial position and which allow the conductor core wire to be inserted through the insertion portion when the pair of elastic pieces is at the deformed position, the pair of elastic pieces being disposed forward and rearward from the holding portion in the front-rear direction and being elastically deformable in the width direction; and a connecting portion which connects extended end parts of the pair of elastic pieces to each other and extends in the front-rear direction; and wherein the pair of elastic pieces are at the deformed position by application of an external force to the connecting portion and then the application of the external force is released in a state that the conductor core wire is inserted through the insertion portion, so that the conductor core wire is fixed by the conductor fixing portion by being sandwiched between the holding portion and the pair of elastic pieces in the width direction by an elastic restoring force of the pair of elastic pieces.

3. A method of connecting the electric wire to the terminal according to claim 1, the method comprising:

housing the terminal in a terminal housing portion of a housing;

applying an external force to the elastic deformation portion of the terminal housed in the terminal housing portion to maintain the elastic deformation portion at the deformed position;

inserting the conductor core wire through the insertion portion in a state that the elastic deformation portion is kept at the deformed position by applying the external force; and fixing the conductor core wire to the conductor fixing portion by releasing the application of the external force in a state that the conductor core wire is inserted through the insertion portion and sandwiching the conductor core wire between the holding portion and the elastic deformation portion in the width direction by an elastic restoring force of the elastic deformation portion.

4. A jig used in the method according to claim 3, the jig comprising:

a pressing portion configured to press the elastic deformation portion of the terminal housed in the terminal housing portion downward from an upper side, wherein, when the pressing portion is pressed downward with respect to the elastic deformation portion, a pressing surface of the pressing portion, which is located at a bottom part of the pressing portion and is configured to press the elastic deformation portion, is inclined to the other side in the width direction with respect to a horizontal surface such that the elastic deformation portion is deformed to the other side.

5. The jig according to claim 4, further comprising:

a guide portion which is located side by side with the pressing portion and is configured to guide the conductor core wire toward the insertion portion, wherein the guide portion and the pressing portion are integrally formed; and wherein a protruding portion, which is configured to guide the conductor core wire toward a center of the insertion portion, is provided on a guide surface which is located at a bottom part of the guide portion and is configured to guide the conductor core wire toward the insertion portion.

* * * * *